US010487521B2

(12) United States Patent
Baron et al.

(10) Patent No.: US 10,487,521 B2
(45) Date of Patent: Nov. 26, 2019

(54) FORMWORK SUPPORT SYSTEM AND METHOD OF INSTALLING A FORMWORK SUPPORT SYSTEM

(71) Applicant: DOKA GMBH, Amstetten (AT)

(72) Inventors: Christoph Baron, Hollenstein an der Ybbs (AT); Philipp Schagerl, Gaming (AT)

(73) Assignee: DOKA GMBH, Amstetten (AT)

( * ) Notice: Subject to any disclaimer, the term of this patent is extended or adjusted under 35 U.S.C. 154(b) by 0 days.

(21) Appl. No.: 15/645,439

(22) Filed: Jul. 10, 2017

(65) Prior Publication Data

US 2019/0010717 A1 Jan. 10, 2019

(51) Int. Cl.

| | |
|---|---|
| ***E04G 11/48*** | (2006.01) |
| ***E04G 11/52*** | (2006.01) |
| ***E04G 11/38*** | (2006.01) |
| ***E04G 17/00*** | (2006.01) |
| ***E04G 25/06*** | (2006.01) |

(52) U.S. Cl.

CPC ..... *E04G 11/52* (2013.01); *E04G 11/38* (2013.01); *E04G 11/486* (2013.01); *E04G 17/002* (2013.01); *E04G 25/061* (2013.01)

(58) Field of Classification Search

CPC ..... E04G 11/38; E04G 11/50; E04G 11/52; E04G 11/486; E04G 17/002

USPC ..... 29/469, 428; 108/147.19, 157.1; 249/18

See application file for complete search history.

(56) References Cited

U.S. PATENT DOCUMENTS

| | | | | |
|---|---|---|---|---|
| 3,397,858 A * | 8/1968 | Williams | E04G 11/50 211/189 |
| 3,430,910 A * | 3/1969 | Bowden | E04G 25/06 248/357 |
| 3,445,084 A * | 5/1969 | Williams | E04G 11/50 249/18 |
| 37,841,151 * | 1/1974 | Steele | E04G 11/486 249/18 |
| 6,176,463 B1 * | 1/2001 | Rock | E04G 11/48 249/18 |

(Continued)

FOREIGN PATENT DOCUMENTS

| | | |
|---|---|---|
| DE | 102006015054 A1 | 10/2007 |
| DE | 202015106999 U1 | 1/2017 |

(Continued)

OTHER PUBLICATIONS http://www.mevaformwork.com/en/formwork/slab-formwork-mevaflex.php — MevaFormwork; MevaFlex; May 8, 2016 (Year: 2016).*

(Continued)

*Primary Examiner* — Michael Safavi

(74) *Attorney, Agent, or Firm* — McCoy Russell LLP

(57) ABSTRACT

A formwork support system comprising:

a first pair of support props, a second pair of support props, a longitudinal beam with opposite ends attached to the first pair of support props, a longitudinal support with opposite ends attached to the second pair of support props, a cantilever beam extending transversely to the longitudinal beam and the longitudinal support, respectively, the cantilever beam being supported on an upper side of the longitudinal support, the cantilever beam having a first end secured to the longitudinal beam.

17 Claims, 20 Drawing Sheets

(56) References Cited

U.S. PATENT DOCUMENTS 6,189,854 B1 * 2/2001 Irurzun Saez De Maturana ..... E04C 3/07 249/18
7,992,836 B2 * 8/2011 Schworer ..... E04G 11/56 249/19
8,262,056 B2 * 9/2012 Schwoerer ..... E04G 11/483 248/357
8,523,137 B2 * 9/2013 Schworer ..... E04G 11/483 249/18
8,616,519 B2 * 12/2013 Bacon ..... E04G 11/483 249/18
2003/0012607 A1 * 1/2003 Coday ..... E04G 11/38 405/272
2004/0075043 A1 * 4/2004 Arozena Bergaretxe ..... E04G 11/38 249/210
2005/0144886 A1 * 7/2005 Holawe ..... E04G 11/38 52/633
2007/0209297 A1 * 9/2007 Schwoerer ..... E04G 11/38 52/127.1
2009/0212195 A1 * 8/2009 Arocena Bergareche ..... E04G 11/38 249/13
2009/0294627 A1 * 12/2009 Schwoerer ..... E04G 11/483 249/18
2010/0115860 A1 * 5/2010 Braun ..... E04C 3/005 52/126.5
2011/0214824 A1 * 9/2011 Beristain ..... E04G 21/16 160/368.1
2015/0069664 A1 * 3/2015 Ciuperca ..... B28B 7/0032 264/333

FOREIGN PATENT DOCUMENTS

DE 102015223762 * 6/2017 ..... E04G 11/50
DE 102016204633 * 9/2017 ..... E04G 11/48
EP 0094246 A2 11/1983
EP 1398432 * 3/2004 ..... E04G 11/38
EP 2952653 * 12/2015 ..... E04G 11/38
FR 3017891 * 8/2015 ..... E04G 11/48
GB 2100331 * 12/1982 ..... E04G 11/48
WO WO-2007003364 A1 * 1/2007 ..... E04G 11/52
WO WO2016116532 * 7/2016 ..... E04G 11/48
WO WO 2017/162423 * 9/2017 ..... E04G 11/48

OTHER PUBLICATIONS http://ghiformwork.com/en/solution/slab-formwork/tableform.html — ghiFormwork; TableForm; March 21, 2014 (Year: 2014).*
http://ghiformwork.com/en/solution/slab-formwork/d50-tables.html — ghiFormwork; D50 Tables; Mar. 20, 2014 (Year : 2014)*
Translation of WO 2017/162,423 (Year: 2017).*
Baron, C. et al., "Formwork Support System and Formwork Support Prop," U.S. Appl. No. 15/645,201, filed Jul. 10, 2017, 34 pages.
ISA European Patent Office, International Search Report and Written Opinion Issued in Application No. PCT/EP2018/068587, dated Aug. 27, 2018, WIPO, 12 pages.

* cited by examiner

FORMWORK SUPPORT SYSTEM AND METHOD OF INSTALLING A FORMWORK SUPPORT SYSTEM

TECHNICAL FIELD

The present disclosure relates generally to a formwork support system.

The present disclosure further relates to a method of installing a formwork support system.

DESCRIPTION OF THE RELATED ART

Such formwork support systems are generally known in the art. One example thereof is disclosed in US 2003/0012607 A1. This shoring and decking system is used for constructing a great variety of concrete structures by supporting a formwork on which cement compositions are poured and then cured. The known system comprises a plurality of vertical legs or post shores with drophead devices mounted thereon. A number of ledgers are individually held and retained by tow drophead devices. In transverse direction, joist members connect to the ledgers. A number of sheets are placed over multiple ledgers and joist members.

It is an object of this present disclosure to improve the formwork support systems known in the prior art. The present disclosure particularly aims at improving safety and stability during shuttering and/or stripping of the formwork, in particular at a marginal area of a building under construction.

SUMMARY OF THE PRESENT DISCLOSURE

In an embodiment, the present disclosure provides for a formwork support system comprising:

a first pair of support props, a second pair of support props, a longitudinal beam with opposite ends attached to the first pair of support props, a longitudinal support with opposite ends attached to the second pair of support props, a cantilever beam extending transversely to the longitudinal beam and the longitudinal support, respectively, the cantilever beam being supported on an upper side of the longitudinal support, the cantilever beam having a first end secured to the longitudinal beam.

In this embodiment, the formwork support system has at least one cantilever beam which, in the casting (support) position for support of a formwork, extends transversely, optionally perpendicularly, to the longitudinal support. The longitudinal beam and the longitudinal support may extend in parallel to one another. The cantilever beam has a first end, a main section and a second end. The first end of the cantilever beam is secured, which may be releasably mounted, to a longitudinal side of the longitudinal beam. The main section of the cantilever beam is supported from below by means of the longitudinal support. The second end of the cantilever beam is cantilevering, i.e. extends beyond the longitudinal support. Thus, the second end of the cantilever beam is arranged without support from below. Depending on the particular construction site, more than one fifth, in particular more than one fourth, of the length (longitudinal extension) of the cantilever beam may protrude beyond the outer longitudinal side of the longitudinal support. The connection between the first end of the cantilever beam and the longitudinal beam in combination with the support of the main section of the cantilever beam on the longitudinal support prevents a lifting of the first end of the cantilever beam when a vertical (downwardly directed) load is applied to an upper side of the second end of the cantilever beam. In this way, the formwork support system is particularly suited for installment at a marginal area of a floor in a building under construction (i.e. an area neighboring a floor edge of the floor on which the formwork support system is installed). This embodiment greatly improves safety during shuttering (i.e. preparation of a casting step) and/or during stripping of the formwork (i.e. removal of the formwork after completion of the casting step). A protruding section of the cantilever beam may horizontally extend beyond a floor edge of the building for facilitation of the working process. This construction improves safety during shuttering as workers may install formwork sheets (panels) on top of the at least one cantilever beam. The space provided on top of the at least one cantilever beam, in particular beyond the floor edge, may be covered with at least one formwork sheet for use as a walk-on area, i.e. a free walkway, for workers, especially in order to install end shutters for a slab edge of the concrete slab to be poured. These installations and manipulations in the marginal area of a floor affords strong safety requirements to avoid accidents on the construction site, especially to prevent workers to fall off the construction site.

Optionally, a plurality of cantilever beams are attached to the longitudinal beam and supported on the longitudinal support.

It is apparent to the person skilled in the art that any multiples of the constituting elements of the formwork support system described herein may be used to cover wider areas in a construction site and/or increase stability of the formwork support system.

For the purpose of this disclosure, all directions and positions, such as "upwards", "downwards", "upper", "lower" etc., are given with respect to a casting position of the formwork support system, in which the support props are arranged vertically and the longitudinal beam, longitudinal support and cantilever beam are arranged horizontally for preparation of the formation of a horizontal concrete slab on top of the formwork. However, it is of course possible, for example, to pour inclined concrete slabs by adjusting the lengths of the support props accordingly. Furthermore, at some instances it is referred herein to interim mounting positions of components of the formwork support system during shuttering and/or stripping of the formwork.

In an embodiment, an upwardly extending tongue member is arranged at the first end of the cantilever beam, wherein the longitudinal beam has an upper slot extending in a longitudinal direction of the longitudinal beam, the tongue member engaging the upper slot of the longitudinal beam. Thus, the tongue member at the first end of the cantilever beam releasably connects to the upper slot of the longitudinal beam. The upper slot has an opening facing downwards for receiving the tongue member which, in the final (casting) position, is directed upwards (i.e. away from the floor on which the formwork support system is installed). For accommodating the tongue member at different positions alongside the longitudinal beam, the upper slot extends in longitudinal direction of the longitudinal beam. The upper slot may extend over more than half of the longitudinal beam. In particular, the upper slot may extend along the entire length of the longitudinal beam except for its opposite ends which may be formed by separate end parts attached to the main section of the longitudinal beam. In this embodiment, the cantilever beam is secured against tilting when loaded from above. Moreover, the upper slot provides for securing the cantilever beam against undesirable lift-out, so that additional means or accessory devices, such as anti-lifting devices, can be omitted. This greatly reduces the risk of dangerous instabilities during installation of formwork sheets (panels) on top of the longitudinal beam and cantilever beam.

In another embodiment, a downwardly extending flange member is arranged at the first end of the cantilever beam, wherein the longitudinal beam has a lower slot extending in a longitudinal direction of the longitudinal beam, the flange member engaging the lower slot of the longitudinal beam. The lower slot may extend over the entire main section of the longitudinal beam (i.e. along the entire length of the longitudinal beam except for the opposite ends thereof). In combination with the connection between the tongue member and the upper slot, the cantilever beam is thus secured against detachment from the longitudinal beam in longitudinal direction of the cantilever beam.

The tongue member may be aligned with the flange member in a longitudinal direction, whereupon they may be formed in one-piece. However, in an embodiment, the tongue member and the flange member are spaced from one another in a longitudinal direction of the cantilever beam. This construction helps to safely anchor the first end of the cantilever beam to a lateral face of the longitudinal beam.

In another embodiment, the tongue member is pivotably arranged at the first end of the cantilever beam about a horizontal axis extending perpendicularly to the longitudinal direction of the cantilever beam. In this embodiment, the cantilever beam may be brought into an inclined position when stripping the formwork while the tongue member is maintained in an upright position engaged with the upper slot of the longitudinal beam.

In another embodiment, a sideward extending stop member is arranged at the first end of the cantilever beam. In the upright casting position of the cantilever beam, the stop member extends sideward and is disengaged from the lower slot of the longitudinal beam. In a lying interim position of the cantilever beam, the stop member extends downwards to engage the lower slot of the longitudinal beam.

In this embodiment, the stop member may be a lateral nose of the tongue member and/or a lateral extension of the flange member.

In an embodiment, a working platform, for example at least one formwork sheet (panel), is arranged on a protruding section of the cantilever beam extending beyond a floor edge of a floor on which the formwork support system is installed. The working platform provides for a free walkway for workers. In particular, formwork sheets may be placed on top of the cantilever beam and at least one end shutter may be installed onto the formwork sheets, which end shutter is used for forming a slab edge of the concrete slab to be poured. The working platform may be formed by the formwork sheets which are installed on top of the at least one cantilever beam and which formwork sheets are extending horizontally beyond the floor edge.

In another embodiment, a fall protection device is mounted on the cantilever beam at its second end. This embodiment greatly reduces the risk of a worker falling off the building when performing work on top of the cantilever beam, for example when placing a plurality of formwork sheets thereon. The fall protection device extends upwards from the cantilever beam. Any known releasable connection may be used to mount the fall protection device to the second end of the cantilever beam.

Optionally, the fall protection device is arranged at a protruding section of the cantilever beam, the protruding section extending beyond a floor edge of the building.

In this embodiment, the fall protection device may comprise at least one railing. Optionally, the railing is mounted on at least a vertical carrier, one end of which is connected to the second end of the cantilever beam.

In another embodiment, each support prop has a leg and a head member mounted on an upper end of the leg, the head member having a support plate with an upper side, the head member having a lowering device for lowering a middle part of the head member, on which the longitudinal beam or the cantilever beam is supported, with respect to the support plate, the leg having a lower leg part, an upper leg part and a connecting device for securing the upper leg part in a plurality of vertical positions with respect to the lower leg part. Such lowering device may comprise a wedge manually moveable to bring the middle part of the head member from an upper casting position to a lower stripping position, whereas the support plate is arranged at the same vertical position in the upper casting position of the middle part as well as in the lower stripping position of the middle part of the head member. In this way, the support plate is arranged for shoring the formwork panel in order to support the concrete slab formed thereon. The connecting device may comprise a bracket manually insertable into one of a plurality of vertically spaced attachment openings of the upper leg part which may slide into the lower leg part. This allows for an adjustment of the length of the support prop.

In another embodiment, the head members of the second pair of support props each have an extension device fixed to the support plate and extending upwards therefrom, the extension device having an upper support plate, a plurality of formwork sheets being supported on the support plates of the first pair of support props and the upper support plates of the second pair of support props.

In another embodiment, a method for installing a formwork support system comprises the steps of:

arranging a first pair of support props on a floor of a building, arranging a second pair of support props on the floor of the building, attaching a first and a second end of a longitudinal beam to the support props of the first pair of support props, respectively, attaching a first end and a second end of a longitudinal support to the support props of the second pair of support props, respectively, supporting a cantilever beam extending transversely to the longitudinal beam and the longitudinal support, respectively, on an upper side of the longitudinal support, securing a first end of the cantilever beam to the longitudinal beam.

In another embodiment, the formwork support system is installed at a marginal area of a floor of a building.

In this embodiment, the longitudinal support may be arranged parallel to a floor edge at the marginal area of the building. In this way, the at least one cantilever beam extends perpendicularly to the floor edge.

Optionally, the second end of the cantilever beam protrudes beyond the floor edge of the building. Thus, the second end of the cantilever beam is arranged outside the vertical plane defined by the floor edge. Optionally, an additional walk-on space is provided on top of the cantilever beam in a protruding section of the cantilever beam extending horizontally beyond the floor edge. Advantageously, the arrangement of the at least one cantilever beam increases the safety of the stripping of the formwork in particular at a marginal area of the floor of the building.

Optionally, the protruding section of the cantilever beam extending beyond the floor edge has a length (longitudinal extension) of more than 20 centimeter (cm), optionally more than 30 cm, in particular more than 80 cm, for example 3 feet (91.44 cm).

In another embodiment, a tongue member at the first end of the cantilever beam is engaged with an upper slot of the longitudinal beam for securing the cantilever beam to the longitudinal beam.

In another embodiment, the cantilever beam is initially supported on the longitudinal support in an interim position with the tongue member placed underneath and disengaged from the upper slot of the longitudinal beam, whereupon the cantilever beam is pivoted about its longitudinal direction so that the tongue member engages the upper slot. This greatly facilitates the mounting of the cantilever beam. Optionally, the cantilever beam is pivoted 90° from its lying interim position to its upright casting (support) position thereby engaging the tongue member of the cantilever beam and the upper slot of the longitudinal beam.

In another embodiment, a tool, for example a fork instrument, is operated from the floor to pivot the cantilever beam in order to engage the tongue member with the upper slot of the longitudinal beam.

In another embodiment, a fall protection element is mounted at the second end of the cantilever beam.

DETAILED DESCRIPTION OF THE DRAWINGS

Figure 1:
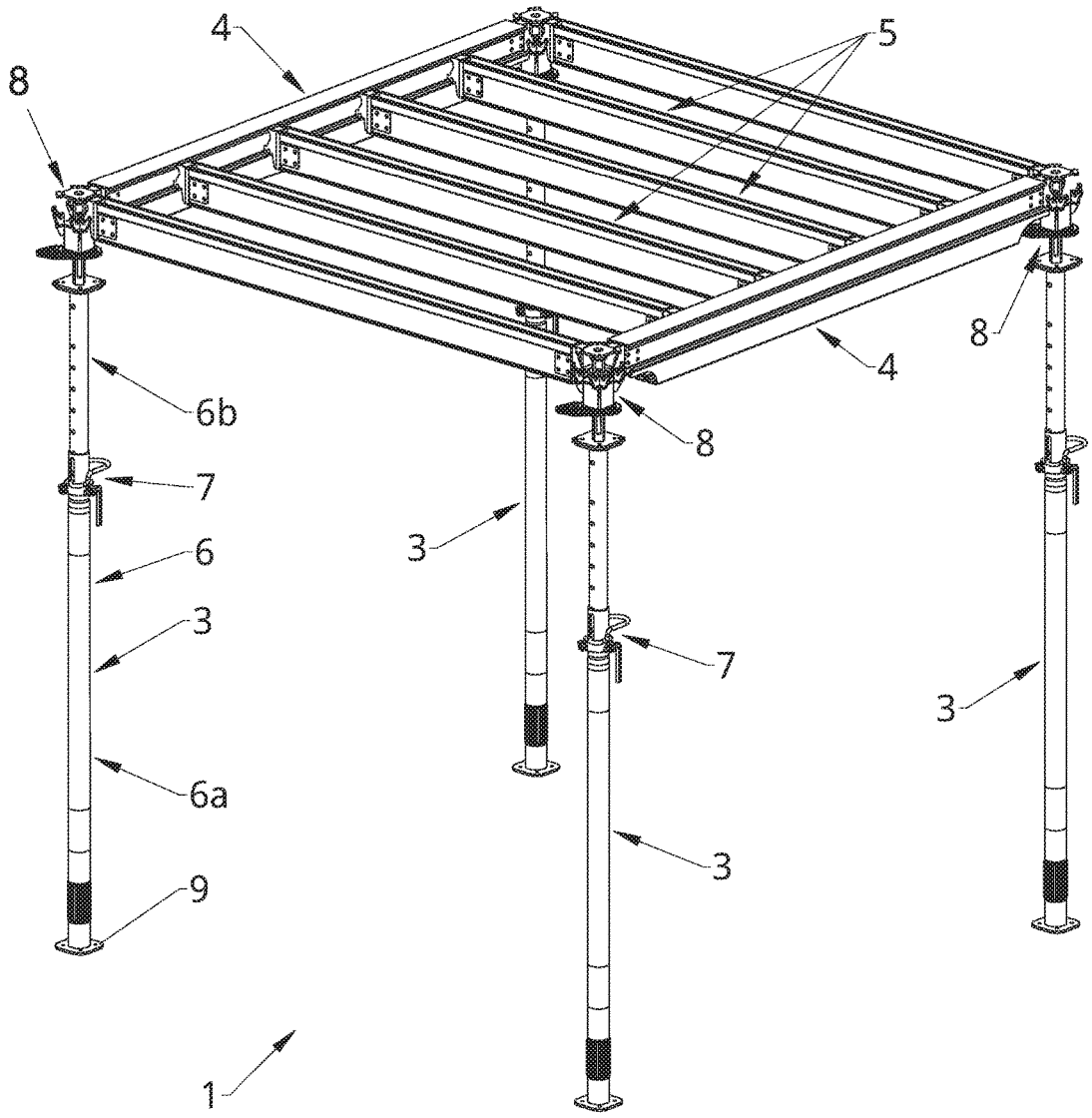
FIGS. 1, 2, 3, 4, 5, 6, 7, 8, 9, 10, 11, 12, 13, 14, 15, 16, 17, 18, 19, 20, 21, 22, 23, 24 and 25 show various views of an interior sub-assembly of a formwork support system and its components.
Figure 6:
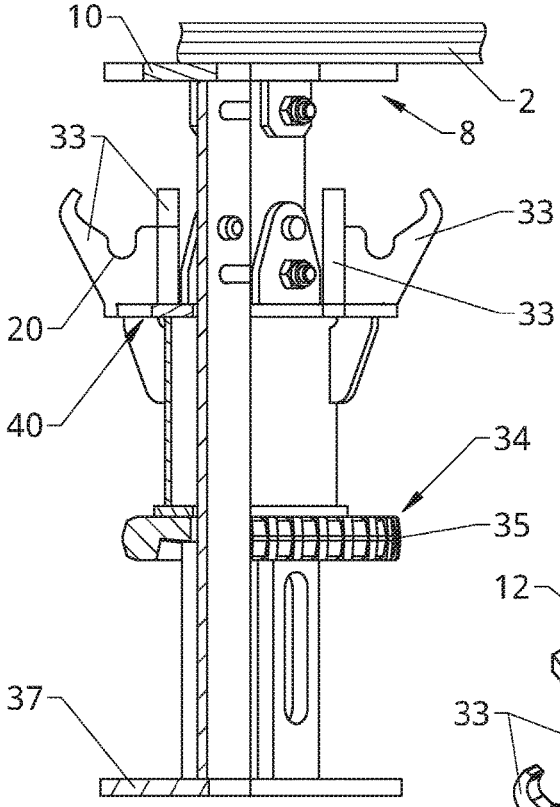

FIG. 1 shows a formwork support system 1 for support of a number of formworks, in particular formwork sheets (panels) of plywood 2 (schematically illustrated in FIG. 6). Such shoring and decking system is used for pouring generally horizontally extending concrete slabs, such as ceilings or floors.

The formwork support system 1 comprises a plurality of support props or support posts 3, a plurality of longitudinal beams, i.e. longitudinal carriers or stringer frames, 4 supported on the support props 3 and a plurality of transverse beams, i.e. crossbars or joist frames, 5 either supported on the support props 3 or on the longitudinal beams 4. The transverse beams 5 extend transversely, optionally perpendicularly, to the longitudinal beams 4.

Each support prop 3 has a leg 6 with a lower leg part 6*a*, an upper leg part 6*b* and a connecting device 7 for securing the upper leg part 6*b* in a plurality of vertical positions with respect to the lower leg part 6*a*. In the shown example, the connecting device 7 has a bracket which may be inserted into one of a plurality of vertically spaced attachment openings of the support prop 3. Furthermore, each support prop 3 comprises a head member 8 mounted on an upper end of the upper leg part 6*b* of the leg 6. The leg 6 of the support prop 3 further has a floor support plate 9 at a lower end of the lower leg part 6*a*.

Figure 2:
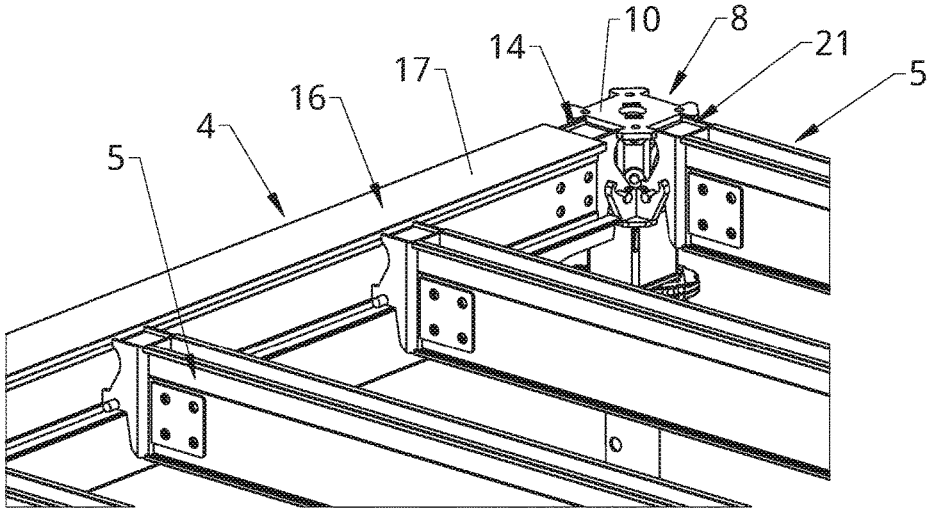
Figure 3:
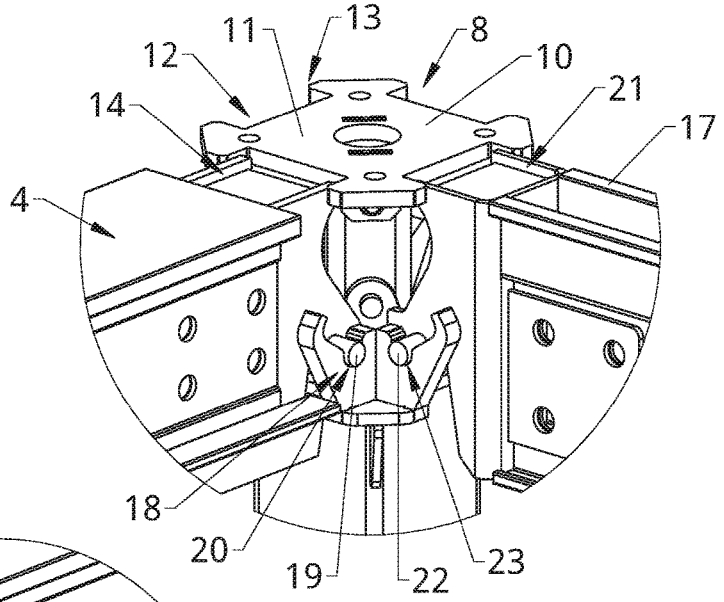
Figure 4:
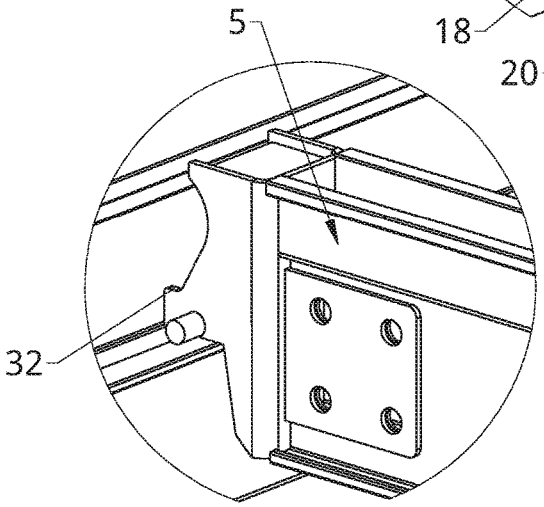

As can be best seen in FIGS. 2 to 4, each head member 8 at its upper end has a support plate 10 with an upper side 11 for supporting the formwork 2 thereon. In the shown embodiment, the support plate 10 has a constant wall thickness (i.e. extension in vertical direction). More generally speaking, the support plate 10 has a plane, horizontally extending upper side 11, whereas the shape of the support plate 10 below the upper side 11 may vary. The support plate 10 has at least one recess 12 formed in a side edge 13 thereof. This recess 12 accommodates an edge portion 14 of the respective end of the longitudinal beam 4. The edge portion 14 of the longitudinal beam 4 and the recess 12 have corresponding extensions in direction perpendicular to the longitudinal axis 15 of the longitudinal beam 4 (illustrated in FIG. 7) such that the edge portion 14 snugly fits into the recess 12 of the support plate 10 of the head member 8. In the assembled state, the snug fit between the edge portion 14 of the longitudinal beam 4 and the recess 12 of the head member 8 prevents tilting of the longitudinal beam 4 with respect to its longitudinal axis 15. Each longitudinal beam 4 comprises a main longitudinal section 16 extending between the opposite ends of the longitudinal beam 4. In the assembled state, the connection of the longitudinal beam 4 with the head member 8 results in a top side 17 of the main longitudinal section 16 of the longitudinal beam 4 being arranged flush with the upper side 11 of the support plate 10 of the head member 8.

In the shown embodiment, the support plate 10 comprises one recess 12 in each one of the four sides of the support plate 10 which has a square ground shape in top view. In this embodiment, neighboring recesses 12 are arranged perpendicular to one another. In this way, the head member 8 forms a crosshead for connection with four longitudinal beams 4 and/or transverse beams 5.

In the assembled state, the end of the longitudinal beam 4 extends downwards from the recess 12 in the support plate 10 of the head member. Furthermore, the head member 8 comprises an intermediary plate 40 arranged between the upper end of the head member 8 and the lower end thereof. The intermediary plate 40 comprises clearances 41 corresponding to the recesses 12 in the support plate 10 (see FIG. 5, 6).

The releasable connection between the longitudinal beam 4 and the head member 8 further comprises a support device 18 for supporting the respective end of the longitudinal beam 4 on the head member 8 in a vertical direction. In the shown embodiment, the support device 18 comprises a pin 19 and a groove 20. The pin 19 is arranged on the longitudinal beam 4 below the edge portion 14 of the head member 8. The groove 20 is arranged on the head member 8 below its support plate 10.

The support device 18 serves for vertically supporting the longitudinal beam 4 on the head member 8, while the form-fit between the edge portion 14 of the longitudinal beam 4 and the recess 12 of the support plate 10 of the head member 8 prevents tilting of the longitudinal beam 4 with respect to its longitudinal axis.

As can be seen from FIGS. 1 to 3, each transverse beam 5 has opposite end regions 21 that snugly fit into the recesses 12 of the head member 8. Furthermore, each transverse beam 5 comprises a bolt 22 that connects to channels 23 of the head members 8. Optionally, bolt 22 and channel 23 for attaching the transverse beam 5 to the head member 8 are identical to pin 19 and groove 20 for attaching the longitudinal beam 4 to the head member 8. For example, two longitudinal beams 4 and two transverse beams 5 may be connected to the same head member 8.

Figure 7:
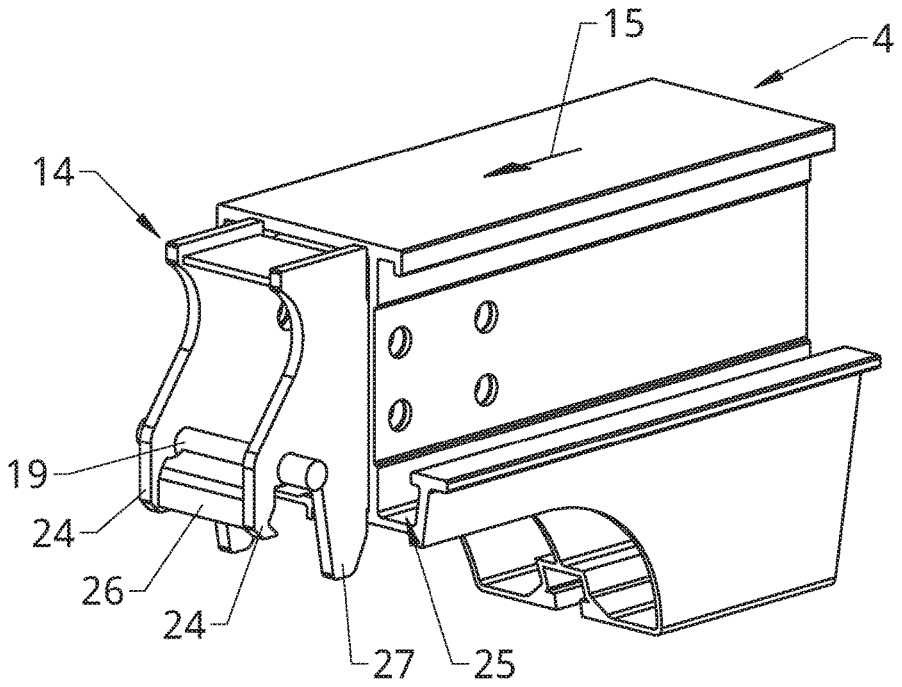
Figure 14:
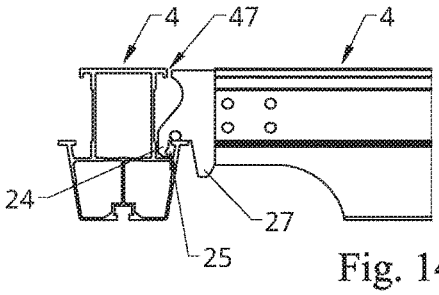
Figure 16:
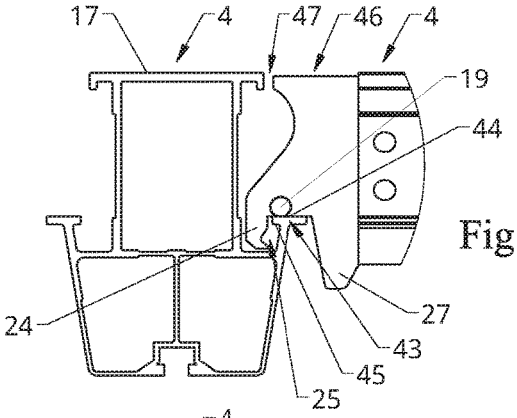

As can best be seen from FIGS. 7, 14 and 16, the longitudinal beams 4 each comprise at least one downwardly projecting hook element 24 and a slot 25 extending in longitudinal direction 15 of the longitudinal beam 4. In this way, the hook element 24 of one longitudinal beam 4 can be connected to the slot 25 of another longitudinal beam 4. In the shown example, the longitudinal beam 4 comprises two hook elements 24 spaced in direction perpendicular to the longitudinal axis 15 and a bracing 26 connecting the two hook elements 24.

Figure 11:
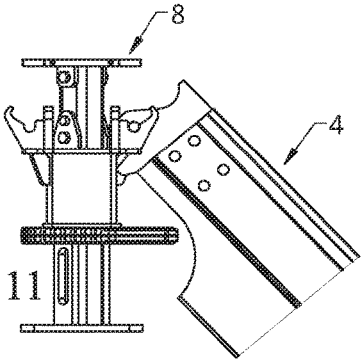
Figure 15:
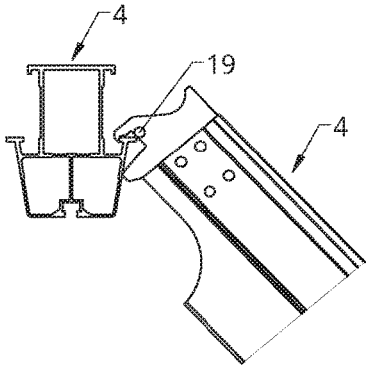
Figure 12:
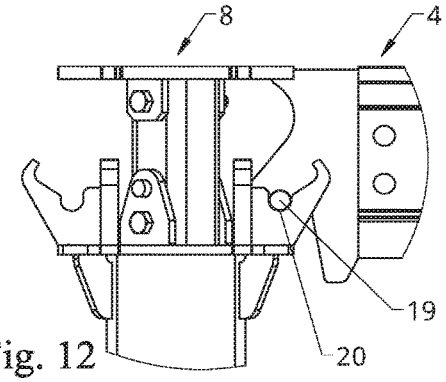
Figure 13:
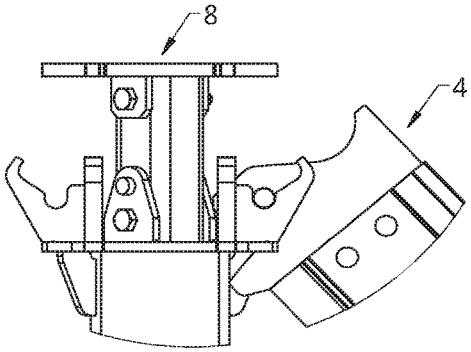
Figure 17:
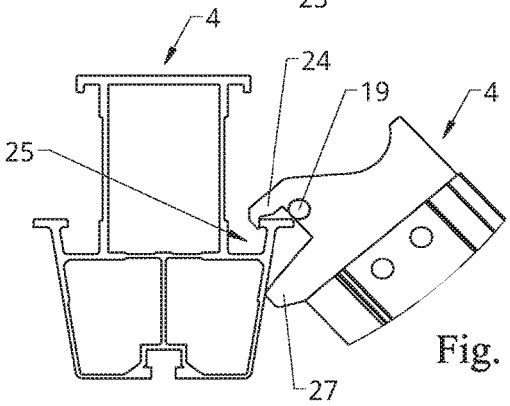
Figure 18:
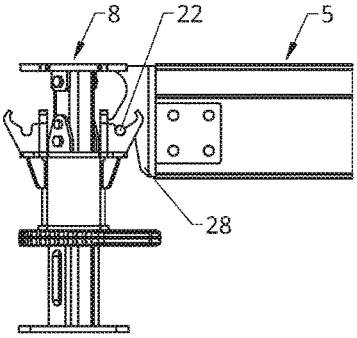

Furthermore, the longitudinal beam 4 comprises a downwardly projecting stop element 27. As can best be seen from FIGS. 11, 13 and FIGS. 15, 17, respectively, the stop element 27 facilitates assembly of the formwork support system 1. First, when connecting a longitudinal beam 4 arranged in an inclined interim mounting position (FIG. 11, FIG. 13) to one of the head members 8, the stop element 27 of the longitudinal beam 4 abuts on the head member 8 of prop 3 to facilitate assembly and improve safety. Second, when connecting a first longitudinal beam 4 arranged in an inclined interim mounting position to a second longitudinal beam 4 arranged in a horizontal final position by means of the hook element 24 of the first longitudinal beam 4 and the slot 25 of the second longitudinal beam 4, the stop element 27 of the first longitudinal beam 4 abuts on a lateral face of the second longitudinal beam 4 (FIG. 15, FIG. 17). In the final position, the stop element 27 of the longitudinal beam 4 is spaced apart from the head member 8 or the other longitudinal beam 4, respectively.

As can be seen from FIGS. 18 to 25, the transverse beam 5 at its end regions comprises stoppers 28, which may be identical to the stop elements 27 of the longitudinal beams 4. When attaching the transverse beam 5 to the head member 8, the transverse beam 5 is first arranged in an interim mounting position extending downwardly towards its free end (see FIG. 19 and FIG. 21) by connecting the bolt 22 of the transverse beam 5 to the channel 23 of the head member 8. In this inclined interim mounting position, the stopper 28 of the transverse beam 5 bears against the head member 8. By lifting the transverse beam 5 from the interim mounting position into its horizontally extending final position, the stopper 28 is placed at a distance from the head member 8.

Furthermore, the transverse beam 5 comprises a downwardly projecting catch element 29 for connection with the slot 25 of the longitudinal beam 4 (see FIGS. 22 to 25). The stopper 28 of the transverse beam 5 bears against a lateral side of the longitudinal beam 4 when the transverse beam 5 is arranged in an inclined interim mounting position (see FIGS. 23 and 25).

The catch element 29 of the transverse beam 5, the hook element 24 of the longitudinal beam 4 and the slot 25 of the longitudinal beam 4 have a shape which provides for an adequate pivoting range in the slot 25.

Figure 8:
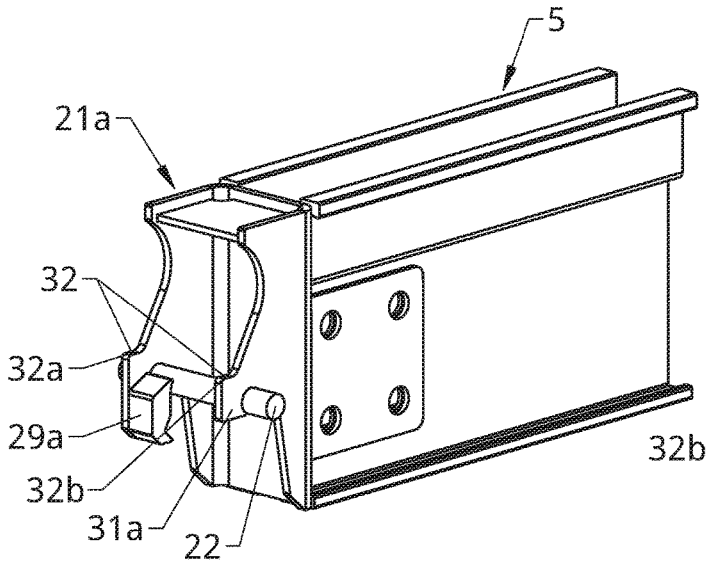
Figure 9:
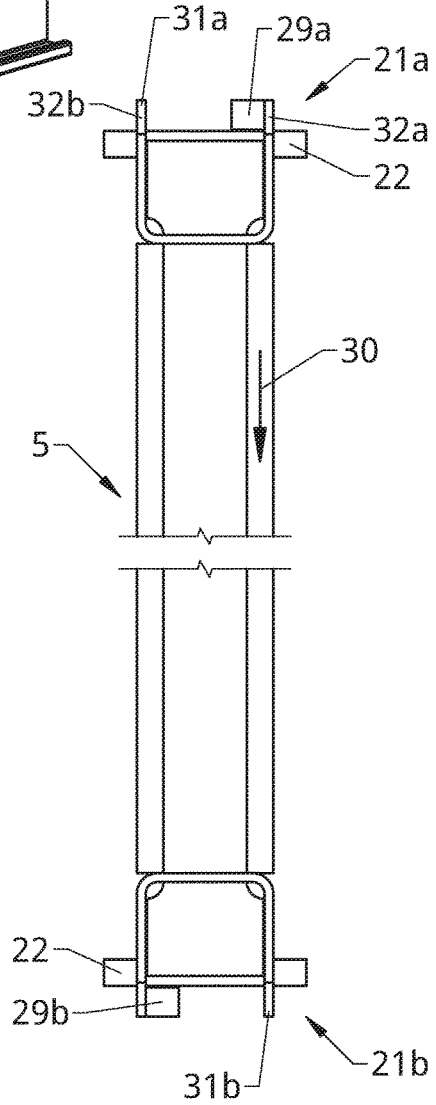
Figure 10:
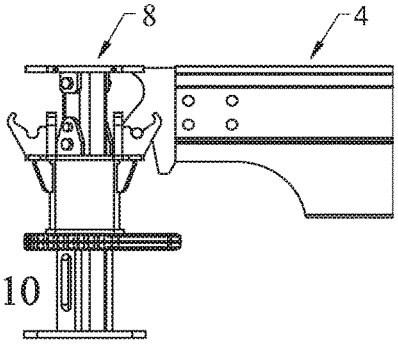

As can best be seen from FIGS. 8, 9, the transverse beam 5 comprises a first catch element 29*a* at a first end region 21*a* of the transverse beam 5 and a second catch element 29*b* at a second end region 21*b* of the transverse beam 5. In the assembled state, each of the first catch element 29*a* and the second catch element 29*b* is connected to the slots 25 of the longitudinal beams 4. For facilitating assembly of the formwork support system 1, the first catch element 29*a* and the second catch element 29*b* are spaced apart in direction perpendicular to a longitudinal direction 30 (see FIG. 9) of the transverse beam 5. In view of increasing stability of the arrangement, the transverse beam 5 further comprises a first abutment element 31*a* at the first end region 21*a* of the transverse beam 5 and a second abutment element 31*b* at the second end region 21*b* of the transverse beam 5. The first catch element 29*a* at the first end region 21*a* and the second abutment element 29*b* at the second end region 21*b* are arranged at the same horizontal position in direction perpendicular to the longitudinal direction 30 of the transverse beam 5. Likewise, the first abutment element 31*a* at the first end region 21*a* and the second catch element 29*b* at the second end region 21*b* are arranged at the same horizontal position in direction perpendicular to the longitudinal direction 30 of the transverse beam 5. In other words, the horizontal position of the catch elements and the abutment elements on the opposite end regions of the transverse beam is interchanged. This arrangement facilitates mounting of the transverse beams 5 to the longitudinal beams 4 when erecting and stripping the formwork support system, which will be described below.

As can be seen from FIGS. 14 to 17 and FIGS. 22 to 25, the slot 25 of the longitudinal beam 4 is delimited by a flange 43 with a top side 44 and an undercut (back taper) 45.

The top side 44 of the flange 43 is arranged for supporting the pin 19 of the longitudinal beam 4 in its final (support) position (see FIG. 16). Furthermore, the top side 44 of the flange 43 is arranged for supporting the bolt 22 or the first abutment element 31*a* or second abutment element 31*b* of the transverse beam 5.

Figure 23:
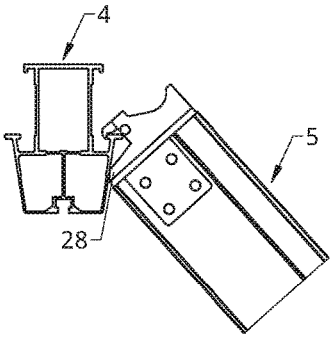
Figure 20:
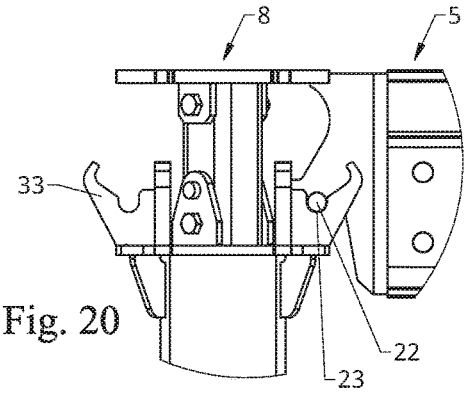
Figure 24:
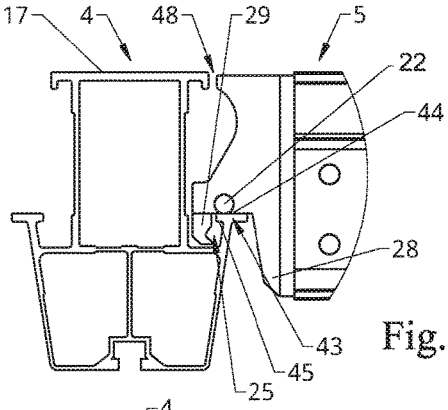
Figure 21:
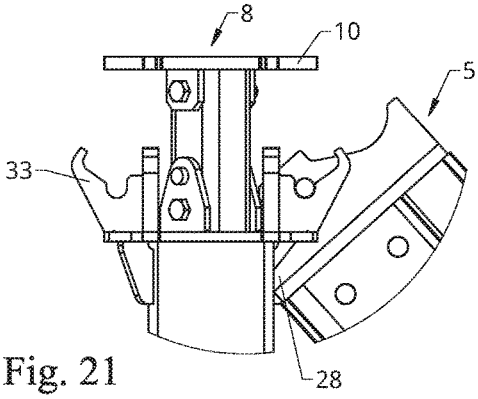
Figure 25:
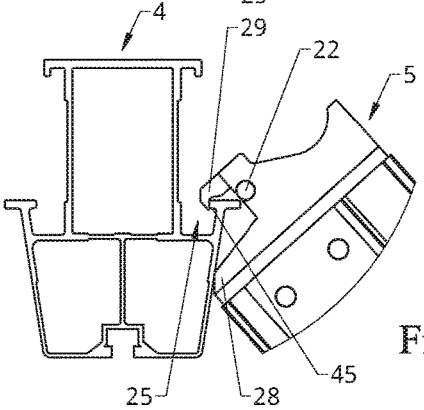

On the other hand, the undercut 45 of the flange 43 is arranged for holding the hook element 24 of the longitudinal beam 4 in its inclined interim mounting position (see FIG. 15, 17) and for holding the catch element 29 of the transverse beam 5 in its inclined interim mounting position (see FIG. 23, 25).

Furthermore, the transverse beam 5 at each end region 21 comprises at least one shoulder 32. In the shown example, two shoulders 32 are provided on either end region 21. A first shoulder 32*a* is formed by a projection of the first catch element 29*a*, a second shoulder 32*b* is formed by a projection of the first abutment element 31*a*.

Figure 5:
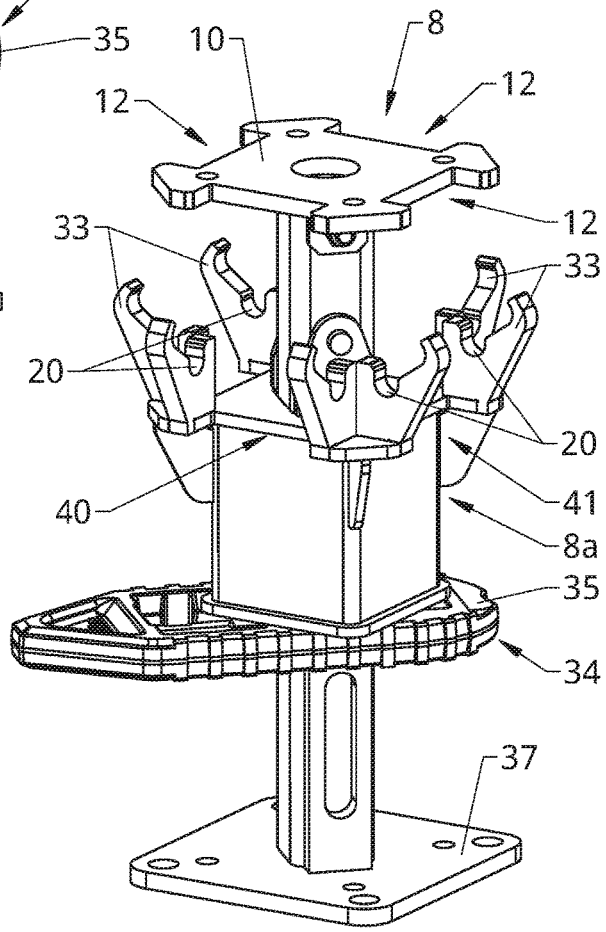

As can best be seen from FIG. 5, FIG. 6, the head members 8 each comprise at least one upwardly projecting holding element 33 with a hook formed at its upper (free) end. In the shown example, two holding elements 33 are provided on either side of the head member 8. Thus, each head member 8 has a total of eight holding elements 33. The holding elements 33 are used for holding the pin 19 of the longitudinal beam 4 when the support prop 3 is brought from an inclined interim position with the lower end of the leg 6 supported on a floor 92 (not shown) to an upright support position (see FIG. 1, FIG. 26 and FIG. 27). Lifting the beams into their horizontal support position for connecting with the head member 8 can, hence, be done without the need to lift the heavy weight of the beam and the prop 3.

As can best be seen from FIG. 5, 6, the head member 8 comprises a lowering device 34 for lowering a middle part 8*a* of the head member 8 with respect to the support plate 10. Thus, the middle part 8*a* may be lowered from the shown upper casting position towards the upper end of the leg 6 to a lower stripping position (not shown). The middle part 8*a* is arranged for supporting at least one of the longitudinal beam 4 and/or the transverse beam 5. For this purpose, the middle part 8*a*, in the shown example, has the grooves 20 for accommodating the pin 19 of the longitudinal beam 4 or the bolt 22 of the transverse beam 5. The lowering device 34 enables a drop head function, which is known in the prior art. In the shown example, the lowering device 34 comprises a wedge 35 which may be moved from a locking position (shown in FIG. 5, 6) to a release position (not shown) for lowering the middle part 8*a* of the head member 8. In the lower stripping position, the middle part 8*a* of the head member 8 is supported by an attachment plate 37 at a lower end of the head member 8 which is mounted on the upper end of the leg 6. The support plate 10 rests in place for supporting the formwork panel positioned thereon.

As indicated in FIG. 14, 16, an upper section 46 of the edge portion 14 of the second longitudinal beam 4 in its horizontal position is spaced by a first gap 47 from an outer edge 48 of the top side 17 of the first longitudinal beam 4 to which the second longitudinal beam 4 is connected. The first gap 47 ensures that the longitudinal beams 4 may not only be arranged in the shown horizontal support positions, but also without blocking in inclined support positions (not shown) when the support props 3 are adjusted to different lengths for pouring inclined concrete slabs.

Figure 22:
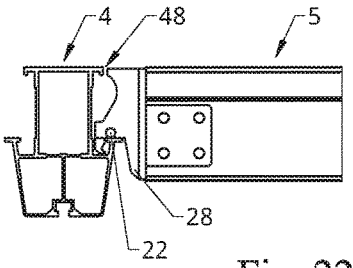
Figure 19:
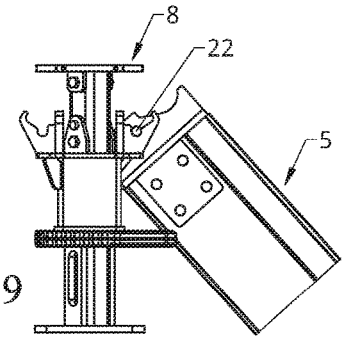

In the same fashion, a second gap 48 is formed at the end regions 21*a*, 21*b* of the transverse beams 5 being connected in a horizontal position to the longitudinal side of the longitudinal beam 4 (see FIG. 22, 24). Such gaps may also be provided for the connection of the longitudinal beam 4 and/or the transverse beam 5 to the head member 8 in a horizontal position, respectively (FIG. 2, 3).

Figure 26:
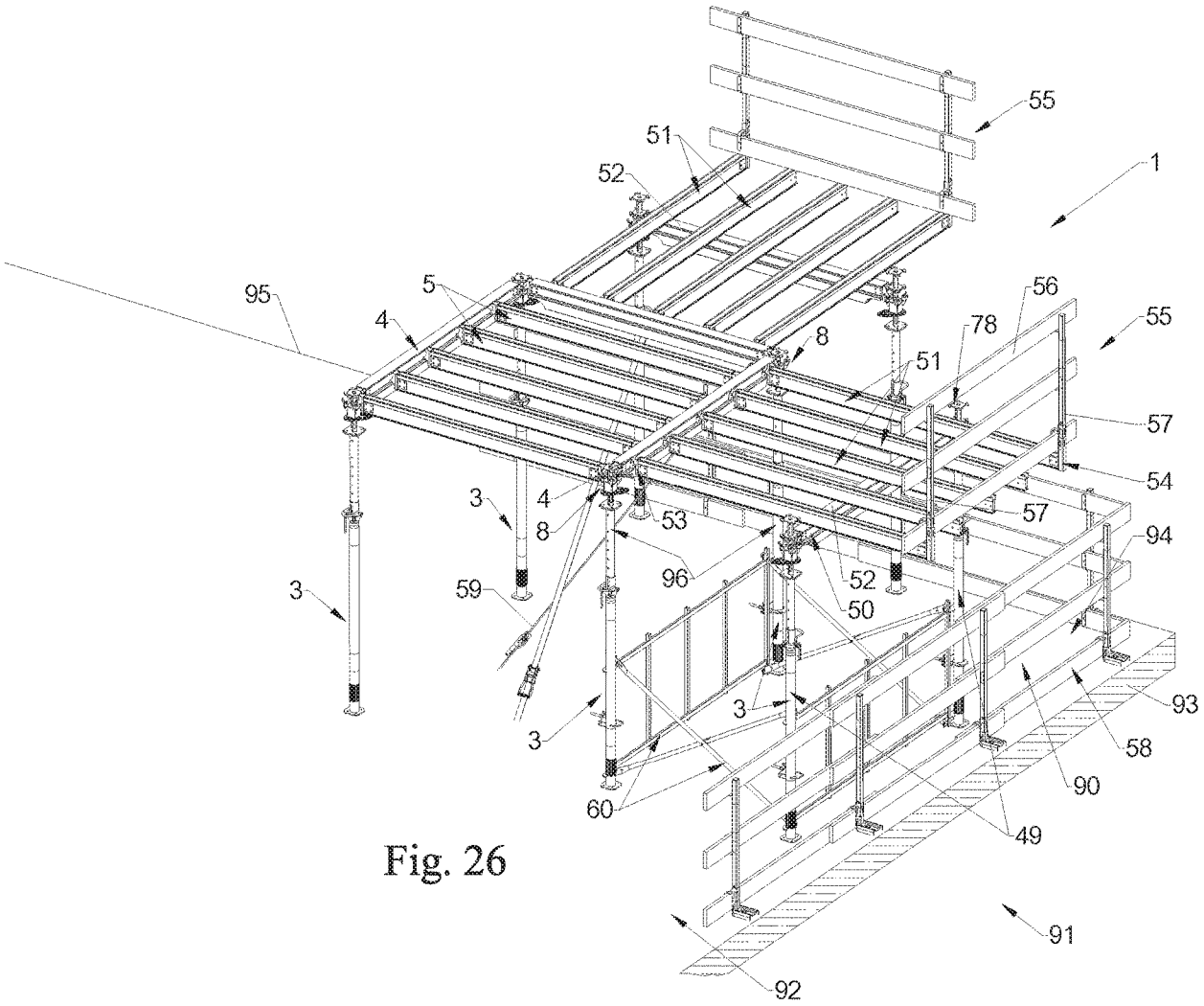
FIGS. 26, 27, 28, 29, 30, 31, 32, 33, 34, 35, 36, 37, 38, 39, 40, 41, 42, 43, 44, 45, 46, 47, 48 and 49 show various views of a formwork support system including the interior area sub-assembly of FIGS. 1 to 25 and two additional marginal area sub-assemblies as well as components thereof.
Figure 27:
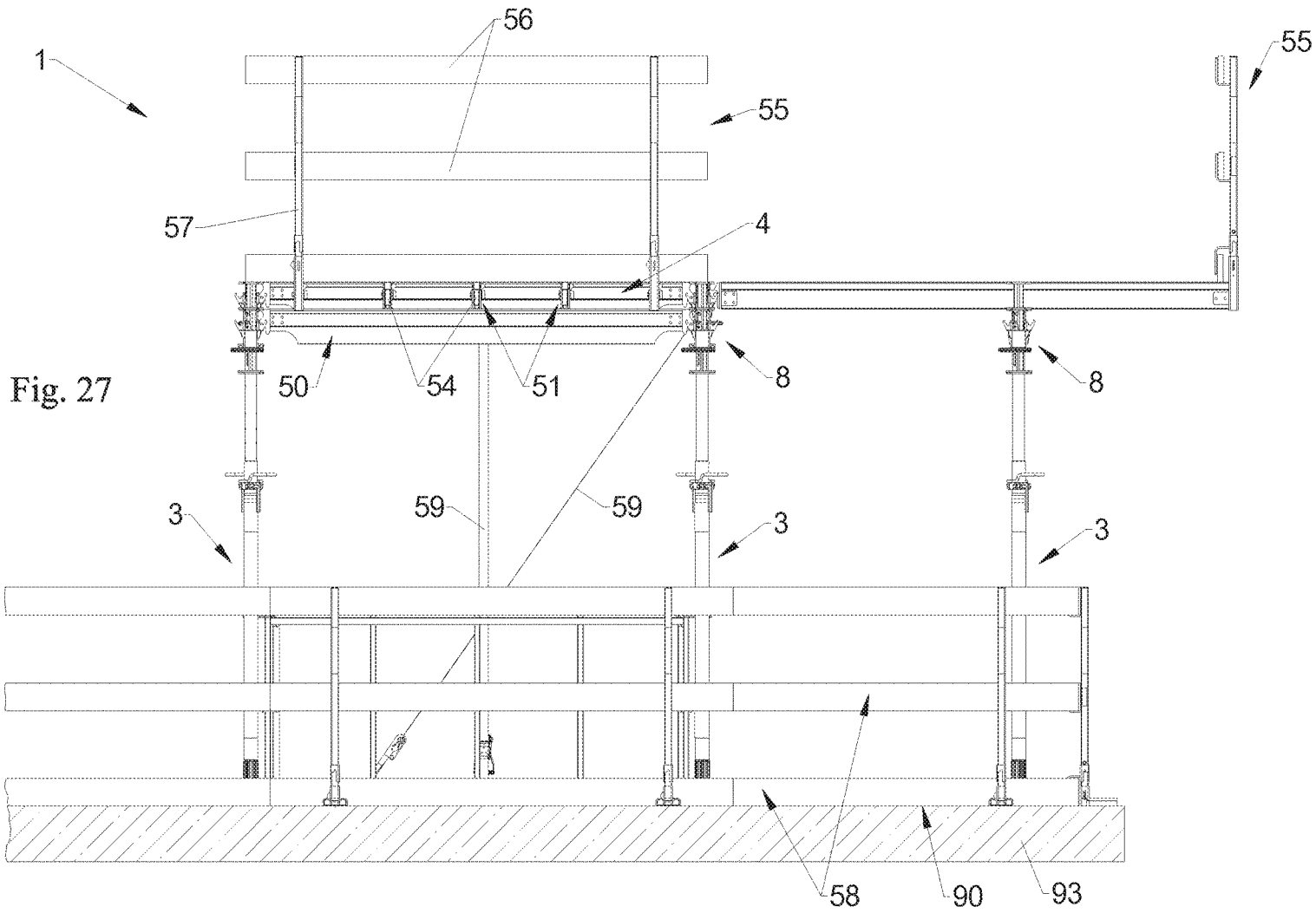
Figure 45:
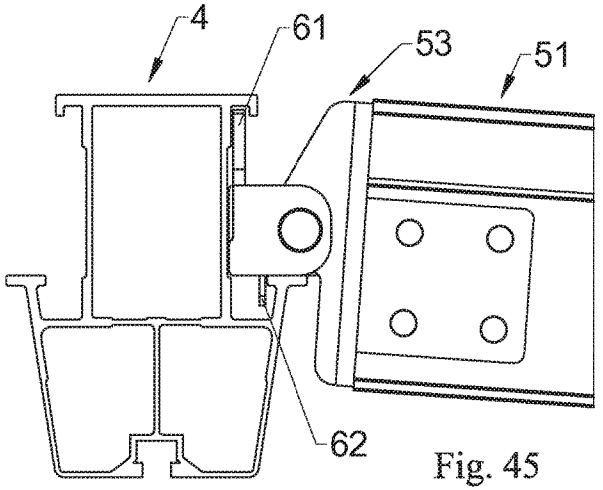

FIG. 26 shows an extension of the formwork support system 1 of FIGS. 1 to 25. In this embodiment, the formwork support system 1 comprises at least one additional sub-assembly for arrangement at a marginal area 90 of a building 91 under construction. As can be seen in FIG. 26, the formwork support system 1 is installed on a floor 92 of the building 91. The floor 92 comprises a floor edge 93 at the marginal area 90. In the shown example, another sub-assembly of the formwork support system 1 is installed at another marginal area 94 with another floor edge 95. Of course, an arbitrary number of such sub-assemblies may be arranged at the marginal regions of a particular building site.

In this embodiment, the formwork support system 1 comprises a first pair 96 of support props 3 for supporting one of the longitudinal beams 4, as was already explained before. The opposite ends of the longitudinal beam 4 are mounted on the head members 8 of the first pair 96 of support props 3. Furthermore, a second pair 49 of support props 3 is installed at the marginal area 90 neighboring the floor edge 93. A longitudinal support (beam) 50 is mounted on the second pair 49 of support props 3. A plurality of cantilever beams 51 are supported on an upper side 52 of the longitudinal support 50. Each cantilever beam 51 has a first (longitudinal) end 53 secured to the longitudinal beam 4 and a second (longitudinal) end 54 protruding beyond the longitudinal support 50 to a vertical plane defined by the floor edge 93. The cantilever beams 51 extend perpendicularly to the floor edge 93 in a horizontal plane. On the other hand, the longitudinal support 50 is arranged parallel to the floor edge 93 at the marginal area 90 of the building 43. These directions are defined with respect to the longitudinal axes of the elongated longitudinal beam, longitudinal support and cantilever beam, respectively. In the shown example, the longitudinal support 50 extends horizontally below the longitudinal beam 4. In particular, the longitudinal support 50 is vertically spaced from the longitudinal beam 4 in accordance with the height (i.e. vertical extension) of the cantilever beam 51. In this way, the cantilever beam 51 and the longitudinal beam 4 on which the cantilever beam 51 is mounted are arranged in the same horizontal plane. This construction results in a horizontal formwork support surface defined by the top sides of the longitudinal beam 4 and the cantilever beam 51.

As can be seen from FIG. 26, 27, a fall protection device 55 is mounted on two cantilever beams 51 at their second ends 54. In the shown example, the fall protection device 55 comprises a number of railings 56 fixed on two vertical carriers 57 attached to the second ends 54 of the two cantilever beams 51. Further railings 58 are installed on floor 44.

The second marginal area sub-assembly of the formwork support system 1 at the other marginal area 94 is identical to the first marginal area sub-assembly of the formwork support system 1 at the marginal area 90.

In the shown example, a tensioning 59 connects the longitudinal beam 4 on which the cantilever beams 51 are mounted to the floor 44. Furthermore, crosslinks 60 may be provided to connect individual support props 3.

Figure 47:
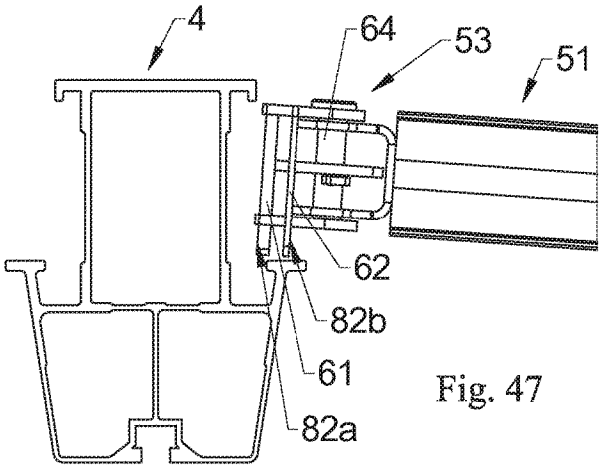
Figure 28:
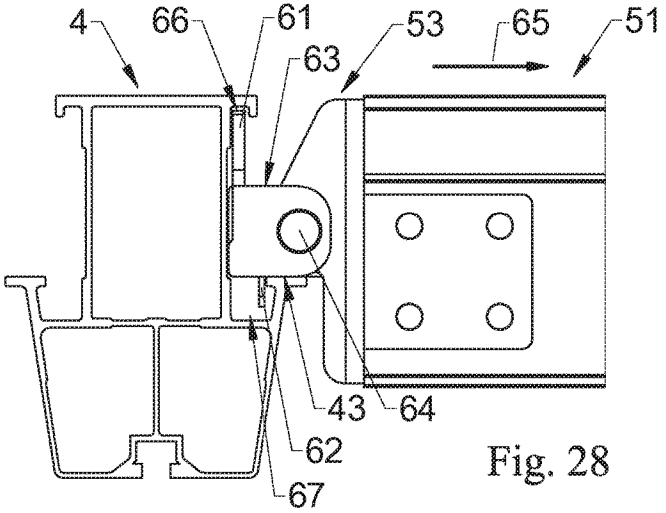
Figure 46:
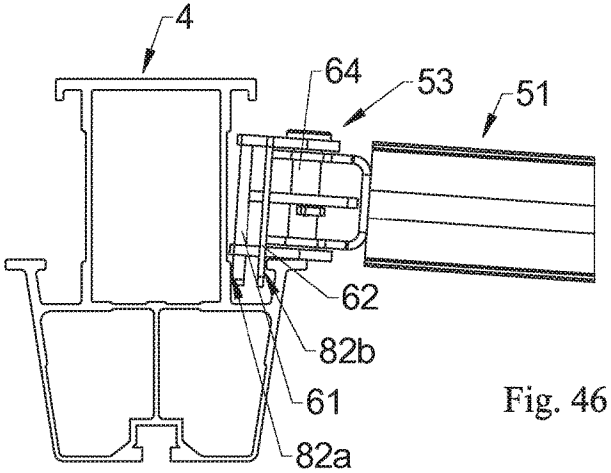
Figure 29:
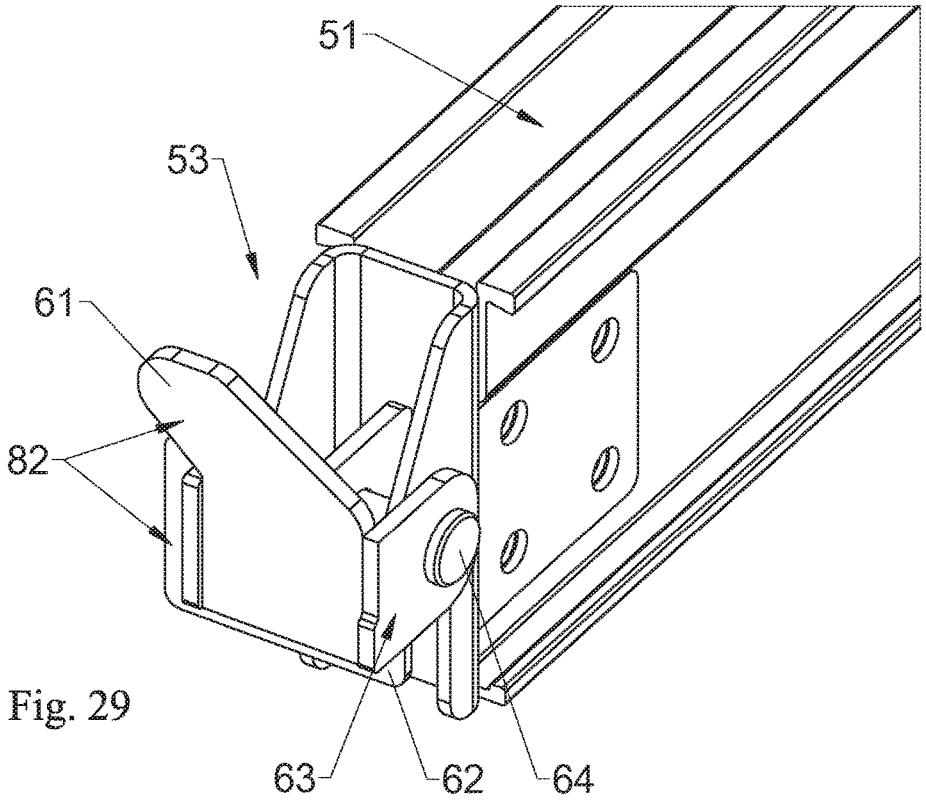
Figure 30:
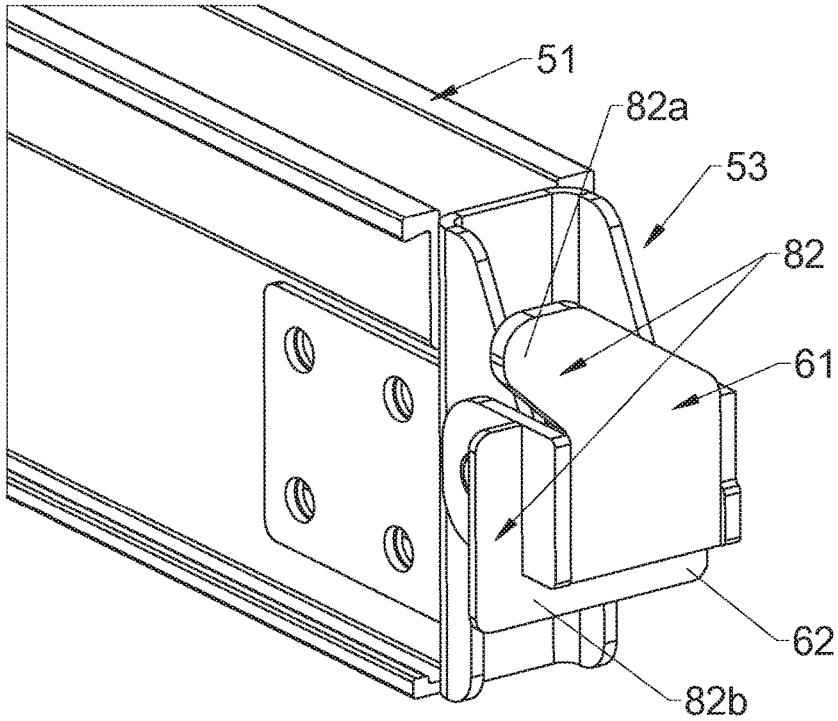

FIG. 28 shows the connection of the cantilever beam 51 to the longitudinal beam 4. In this embodiment, an upwardly extending tongue member 61 and a downwardly extending flange member 62 are mounted to the first end 53 of the cantilever beam 51. Furthermore, at least one sideward extending stop member 82 is arranged at the first end of the cantilever beam 51 (FIG. 29, FIG. 30). In the shown example, two sideward extending stop members 82 are formed by a lateral nose 82*a* of the tongue member 61 and a lateral extension 82*b* of the flange member 62, respectively (FIG. 46, FIG. 47).

The tongue member 61 and the flange member 62 are fixed on a pivot device 63 which is mounted on the first end 53 of the cantilever beam 4. The pivot device 63 is pivotable about a horizontal axis 64 extending perpendicularly to a longitudinal axis 65 of the cantilever beam 51. This allows for the pouring of inclined concrete slabs and further avoids canting during the stripping process. In the shown example, a vertical extension of the tongue member 61 is greater than a vertical extension of the flange member 62.

The longitudinal beam 4 has an upper slot 66 and a lower slot 67 extending in a longitudinal direction 68 (see FIG. 31) of the longitudinal beam 4 at a lateral face thereof, respectively. In the casting position of the formwork support system 1, the tongue member 61 of the cantilever beam 51 engages the upper slot 66 of the longitudinal beam 4. In a similar fashion, the flange member 62 engages the lower slot 67 of the longitudinal beam 4. The tongue member 61 and the flange member 62 are spaced from one another in longitudinal direction 65 of the cantilever beam 51. In the upright casting position of the cantilever beam 51 (see FIG. 28), the stop members 82 are disengaged from the lower slot 67 of the longitudinal beam 4.

FIGS. 31 to 37 show the formwork support system 1 in different stages of the shuttering process for preparation of a casting step.

Figure 31:
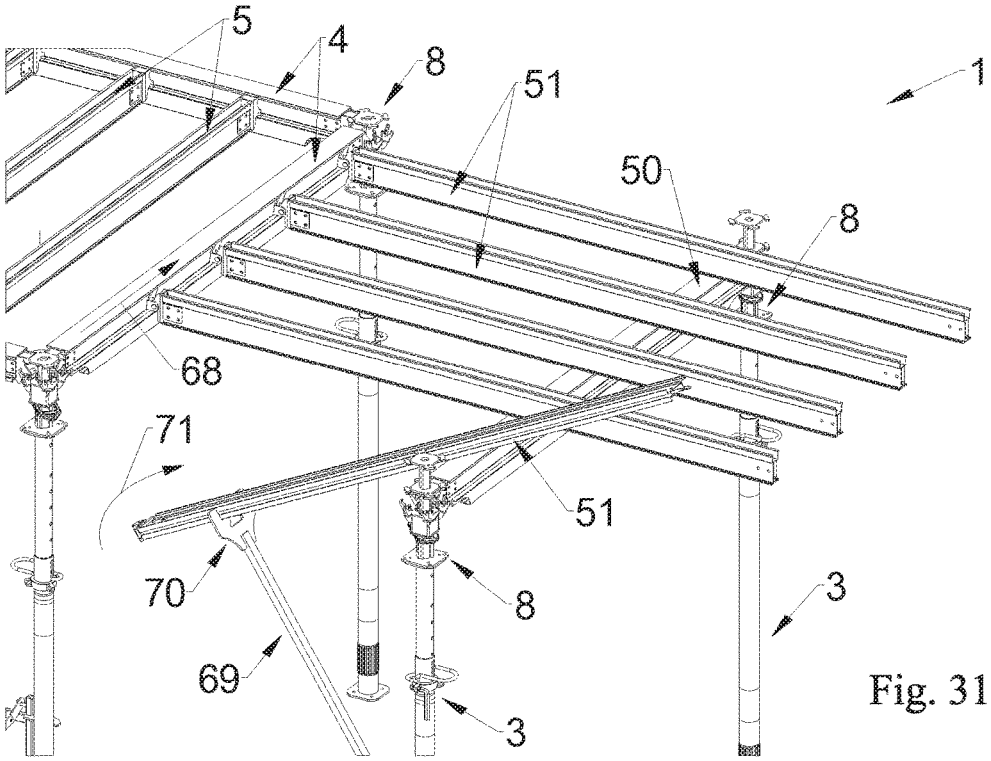
Figure 32:
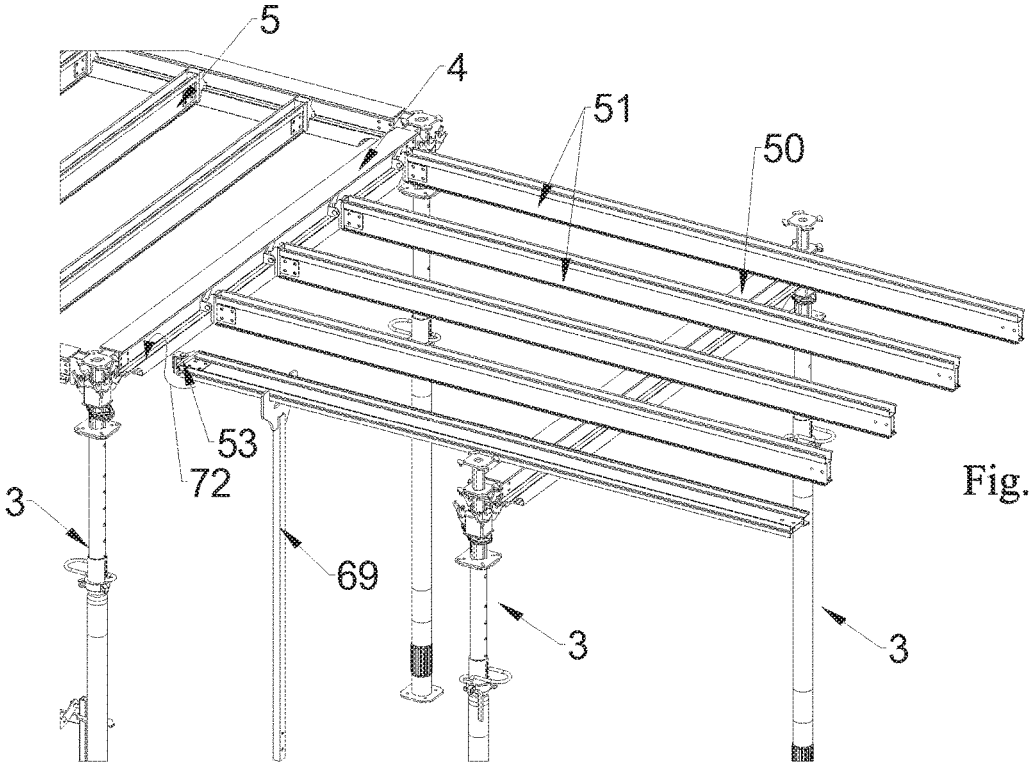
Figure 33:
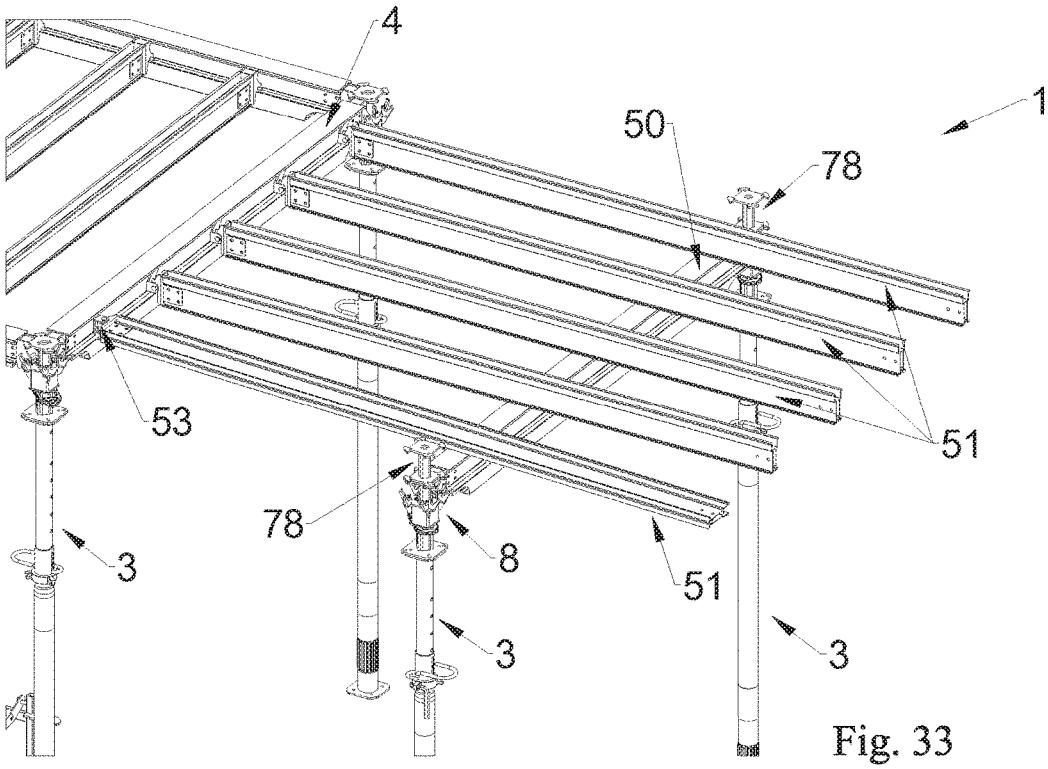

According to FIG. 31, a number of cantilever beams 51 have been attached to the longitudinal beam 4 and rest on the upper side of the longitudinal support 50. Another cantilever beam 51 is added to the formwork support system 1. For this purpose, a manually operable fork instrument 69 with a fork 70 at one of its ends is used. The cantilever beam 51 is first lifted with the fork instrument 69 onto the longitudinal support 50 (see arrow 71 in FIG. 31). Next, the cantilever beam 51 is arranged in a lying position supported on the cantilever beam 51 (FIG. 32). In this lying position, the cantilever beam 51 is pivoted by 90 degrees with respect to its final mounted position shown for the other cantilever beams 51 (see FIG. 32). In the next step, the first end 53 of the cantilever beam 51 is first moved longitudinally towards the longitudinal beam 4 and is then lifted into the space defined between the upper slot 66 and the lower slot 67 of the longitudinal beam 4 (see arrow 72 in FIG. 32). Thus, the cantilever beam 51 is arranged in an interim position with the tongue member 61 placed underneath and disengaged from the upper slot 66 of the longitudinal beam 4 (see FIG. 33). In this position, the stop members 82 extend downwards to engage the lower slot 67 of the longitudinal beam 4 by abutting on opposite sides of the lower slot 67.

Figure 34:
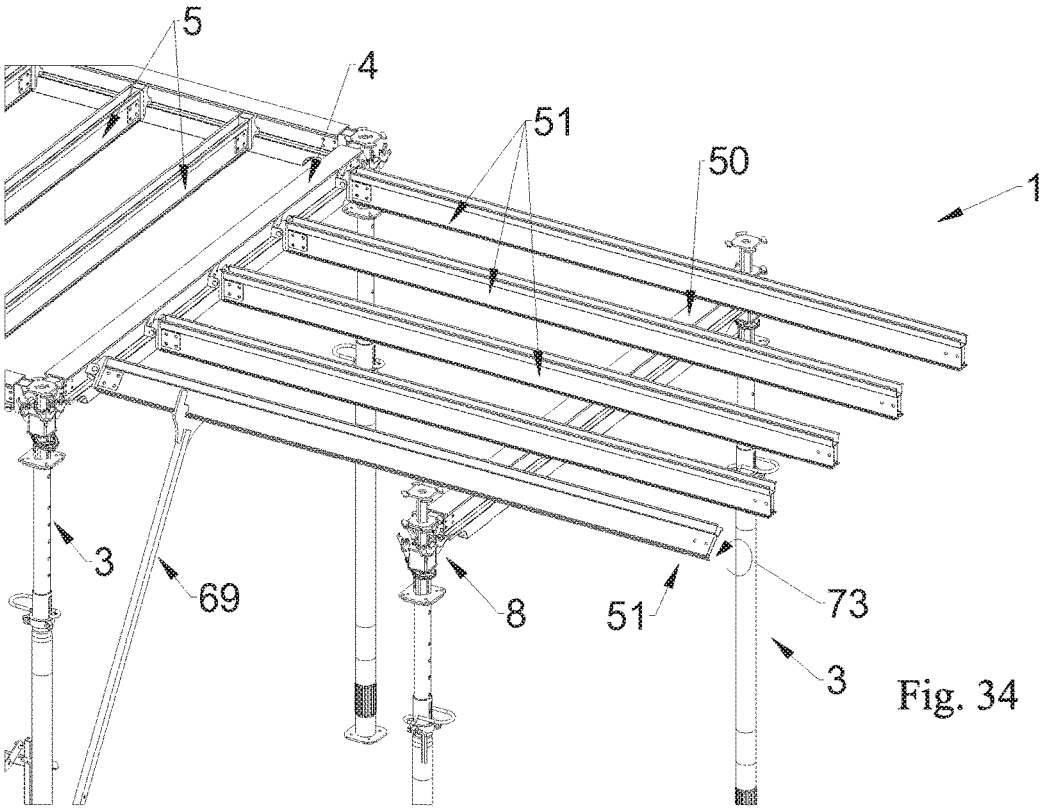
Figure 35:
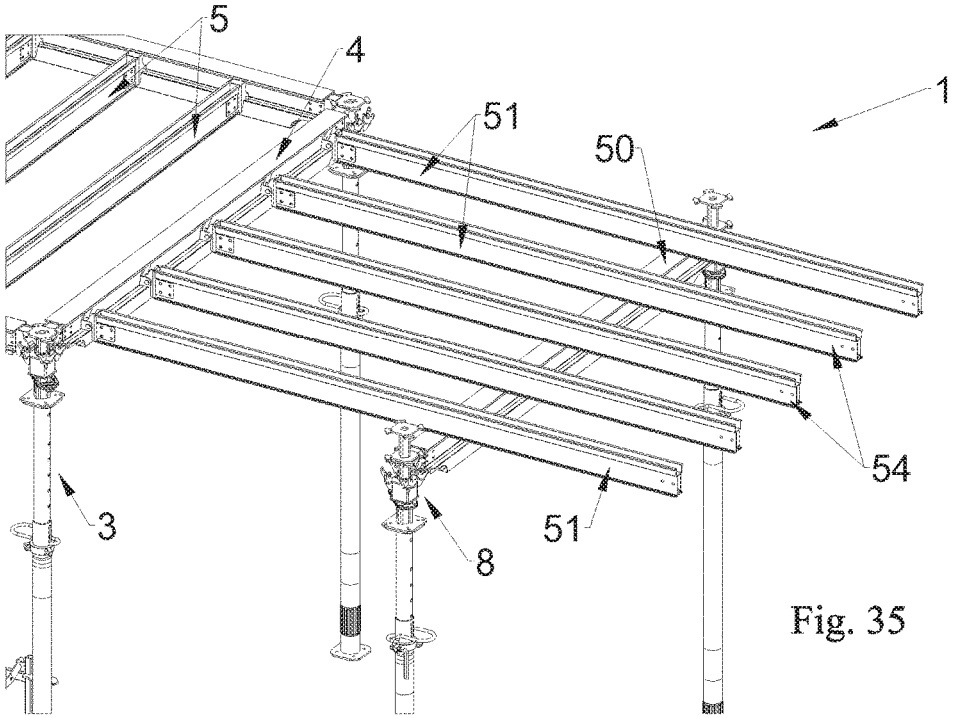

In the next step, shown in FIG. 34, the cantilever beam 51 is turned about its longitudinal axis (i.e. its longitudinal direction 65) by 90° (see arrow 73 in FIG. 34). As a result, the cantilever beam 51 is arranged in its final position, in which the tongue member 61 engages the upper slot 66 of the longitudinal beam 4 (see FIG. 35).

Figure 36:
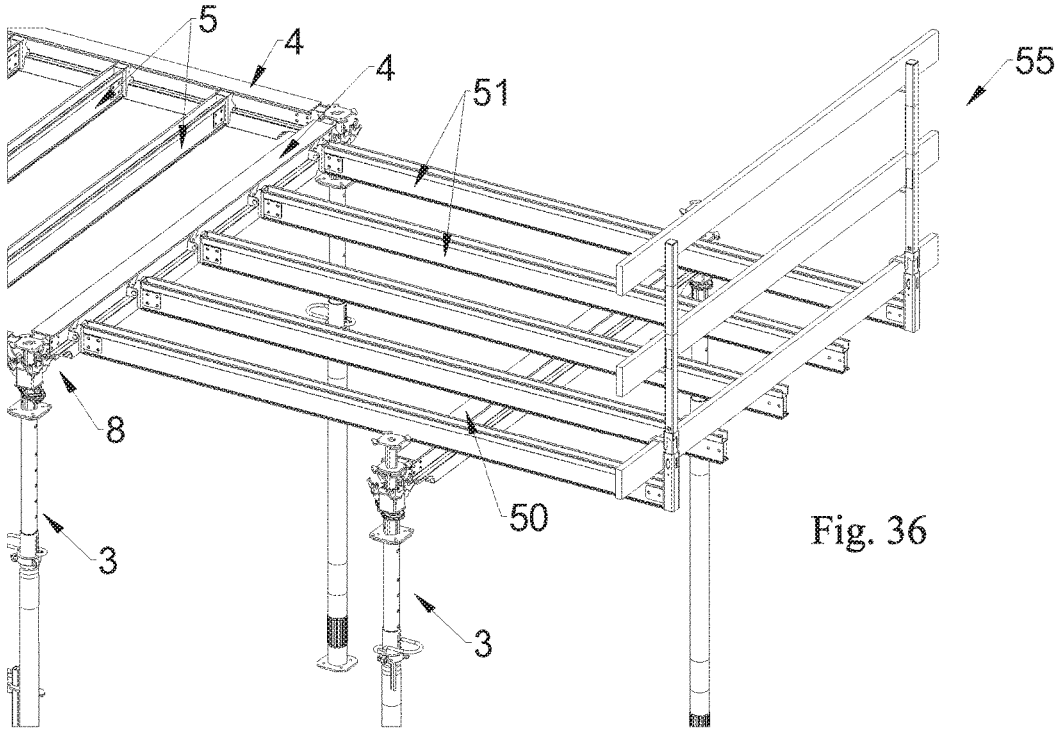

In the next step, the fall protection device 55 is mounted on the second ends 54 of the cantilever beams 51 (see FIG. 36).

Figure 37:
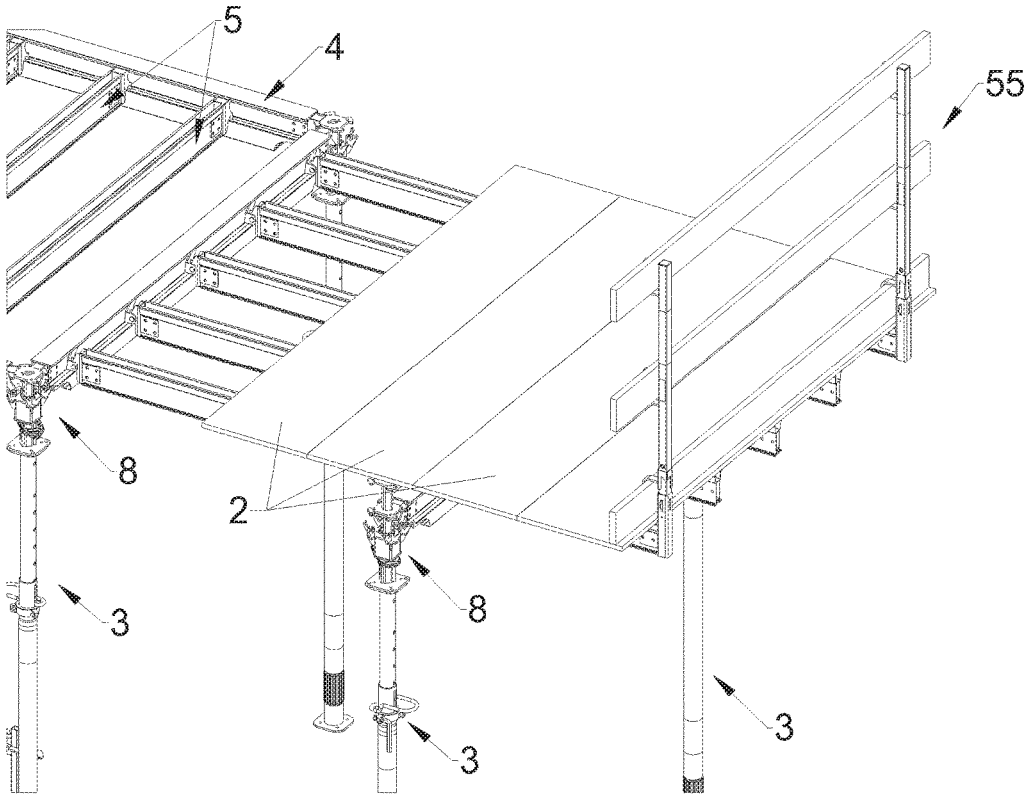

In the next step, a plurality of formwork sheets 2 are placed over the support surface defined by the top sides of the longitudinal beam 4 and cantilever beams 51 (see FIG. 37).

FIGS. 38 to 47 illustrate the stripping of the formwork in particular after completion of the casting step.

Figure 38:
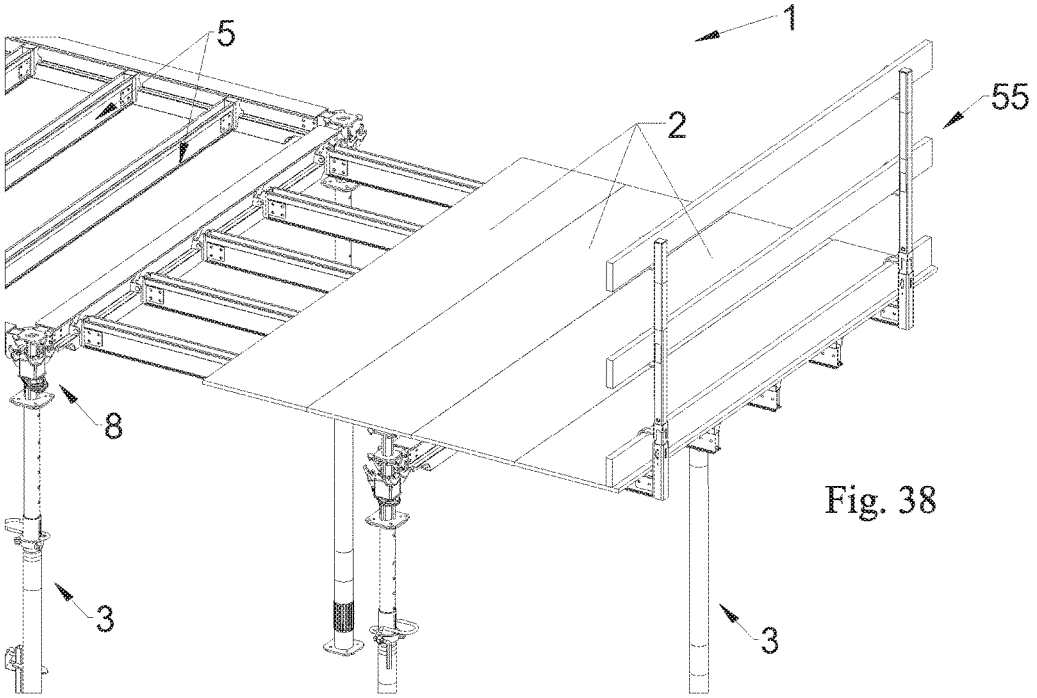

FIG. 38 shows the casting position of the formwork support system 1 which is to be removed for transport to the next level of the building 43.

Figure 39:
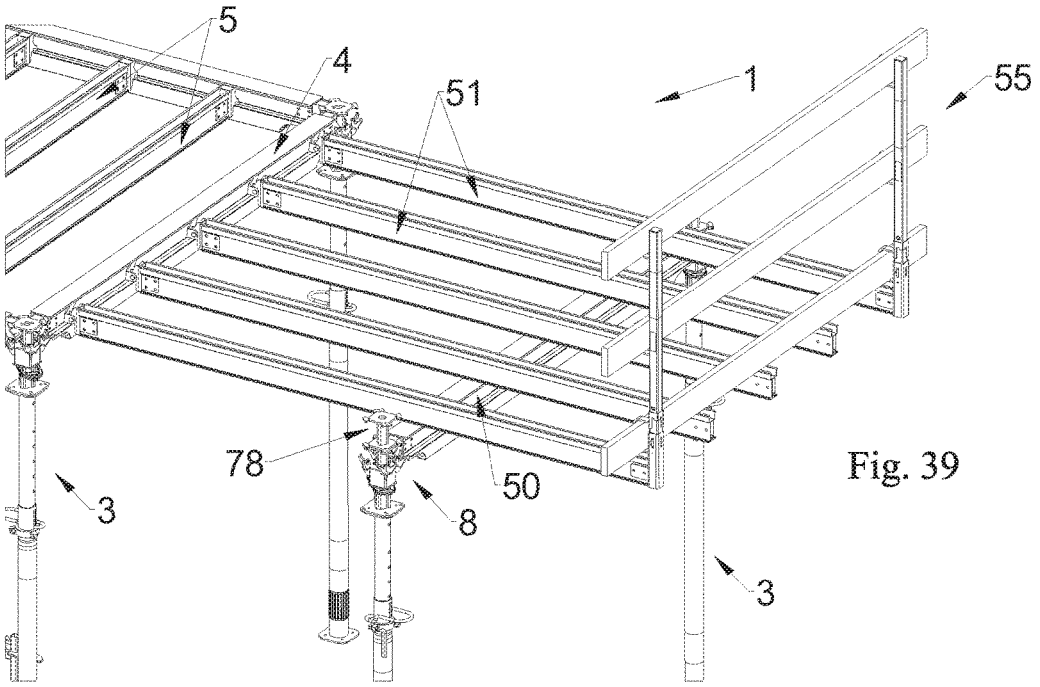

In the next step, the formwork sheets 2 are removed (see FIG. 39).

Figure 40:
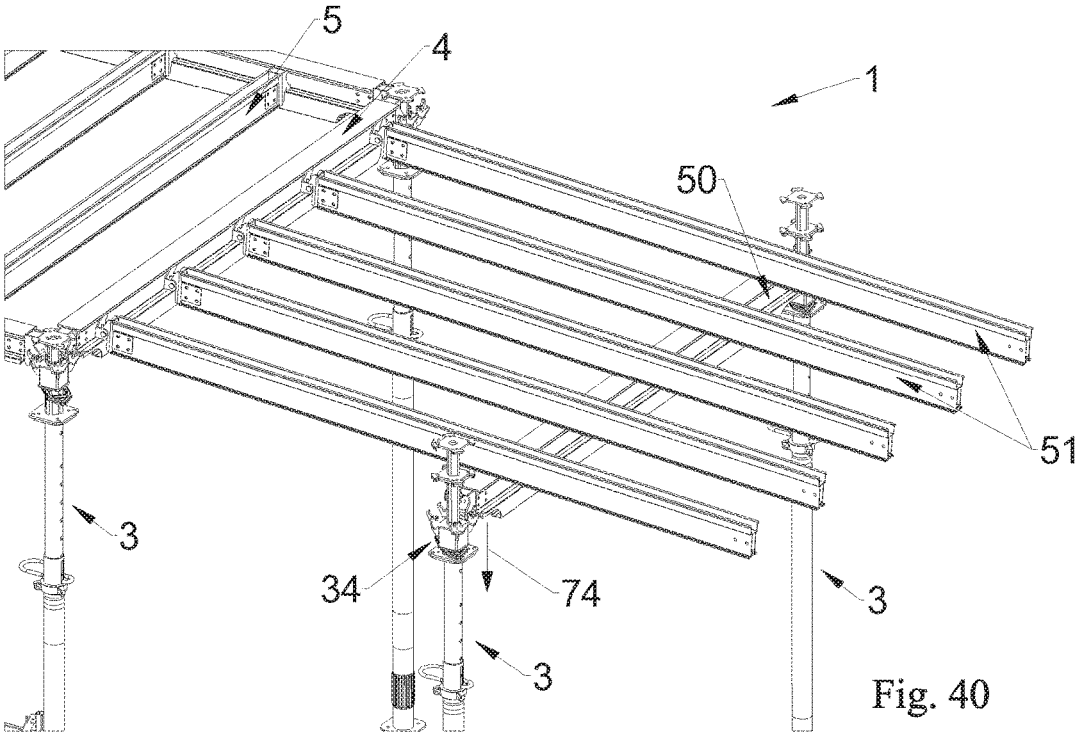
Figure 41:
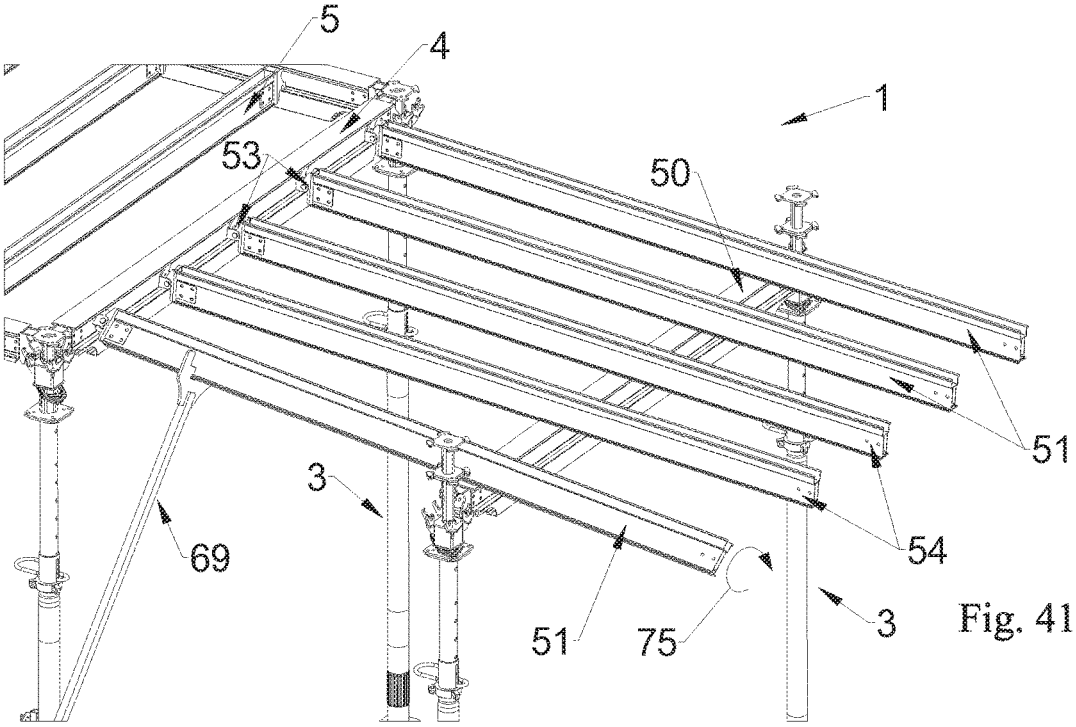

In the next step, the lowering devices 34 of the second pair of support props 3 are activated to lower the second ends 54 of the cantilever beams 51 (illustrated by arrow 74 in FIG. 40). This results in a pivoting of the pivoting members 63 at the first ends 53 of the cantilever beams 51 (see the detail view of FIG. 45).

In the next step, the fork instrument 69 is operated to turn the cantilever beam 51 by 90 degrees (see arrow 75 in FIG. 41) with respect to its longitudinal direction (axis) to disengage the tongue member 61 from the upper slot 66 of the longitudinal beam 4.

Figure 42:
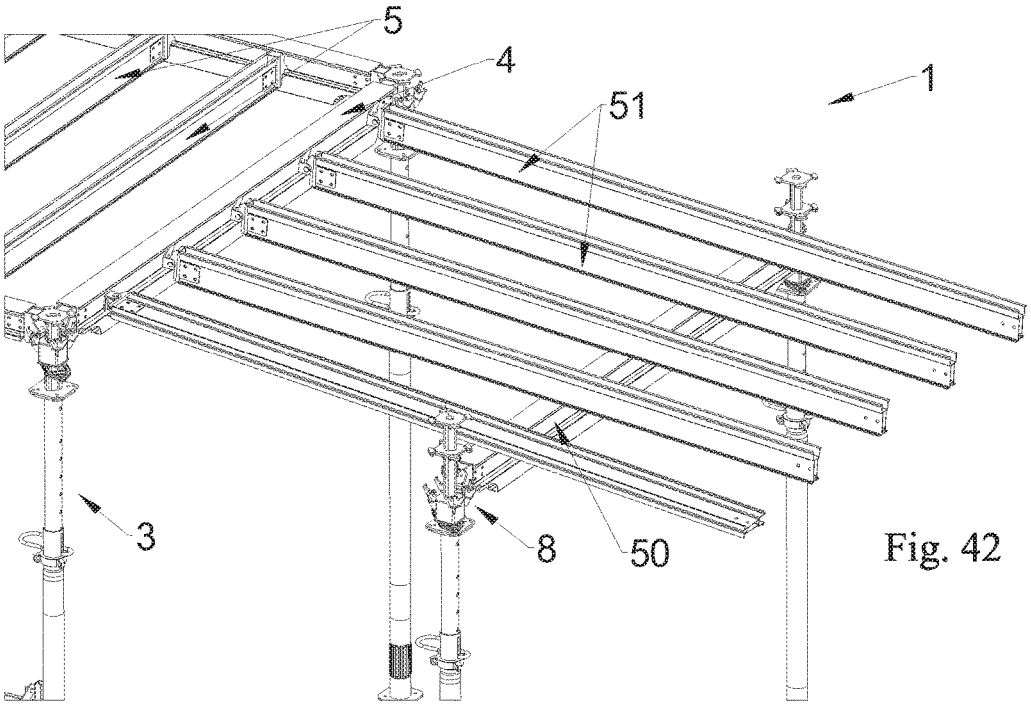
Figure 43:
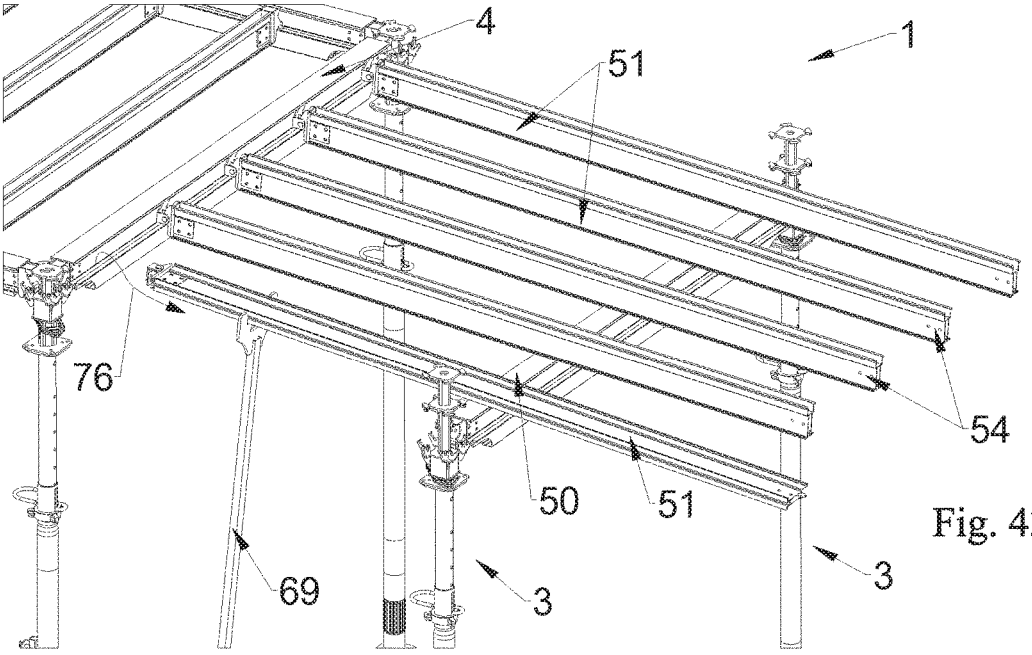

Next, the cantilever beam 51 is first arranged in its lying interim (intermediary) position (see FIG. 42 and FIG. 46). In this lying interim position, the stop members 82 extend downwards to engage the lower slot 67 of the longitudinal beam 4 by abutting on opposite sides of the lower slot 67. The cantilever beam 51 is then removed from the longitudinal beam 4 by lifting the first end 53 of the cantilever beam over the flange 43 delimiting the lower slot 67 (see arrow 76 in FIG. 43, see also FIG. 47).

Figure 44:
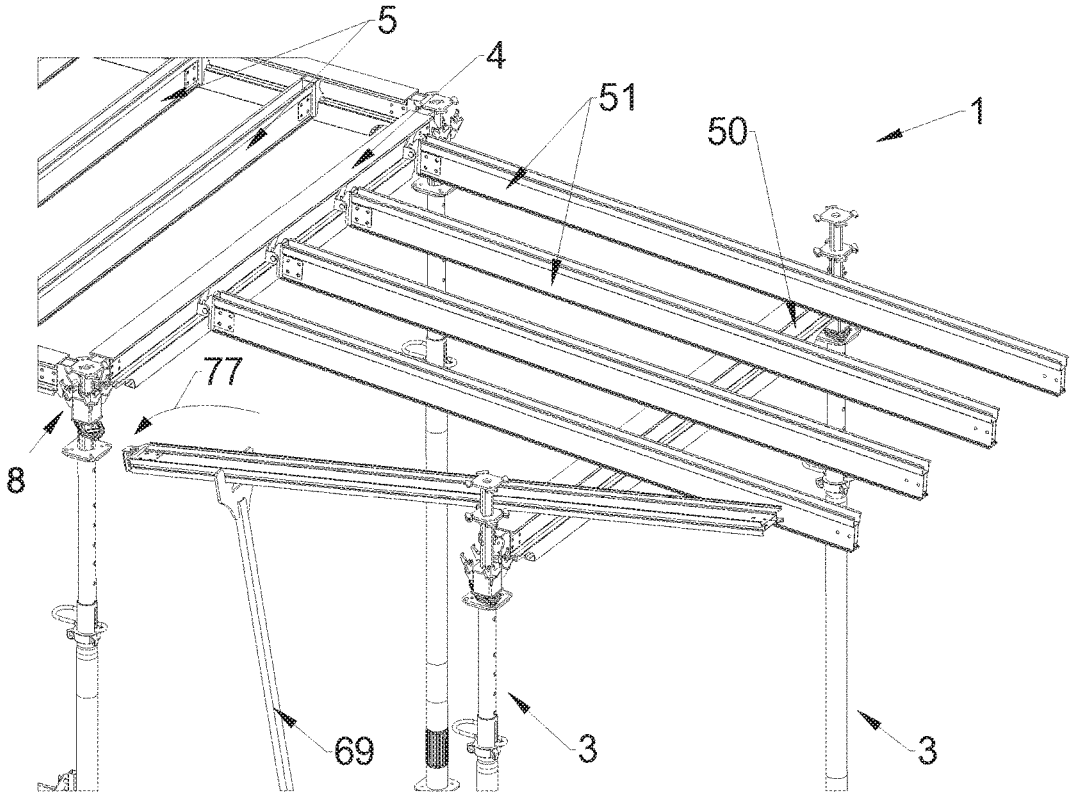
Figure 49:
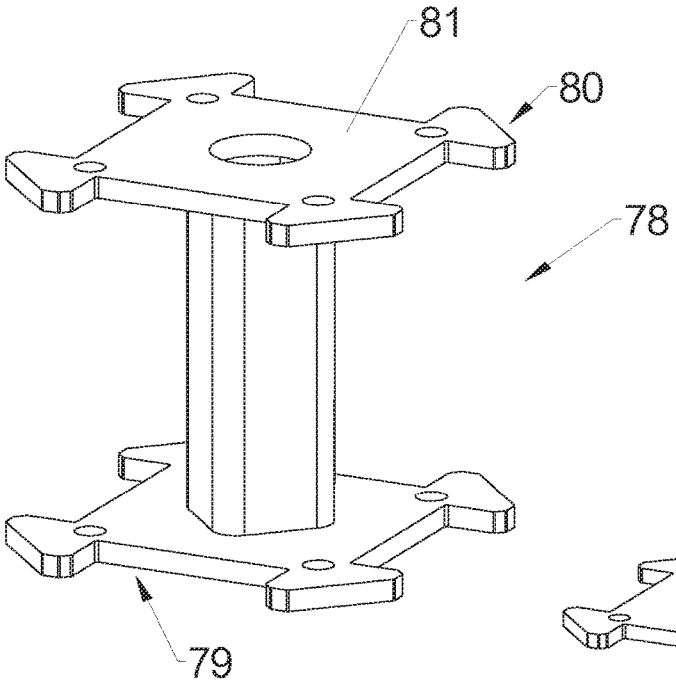

Finally, the first end 53 of the cantilever beam 51 may be lowered towards floor 44 of the building 43 (see arrow 77 in FIG. 44). The same procedure is followed for the remaining cantilever beams 51.

Figure 48:
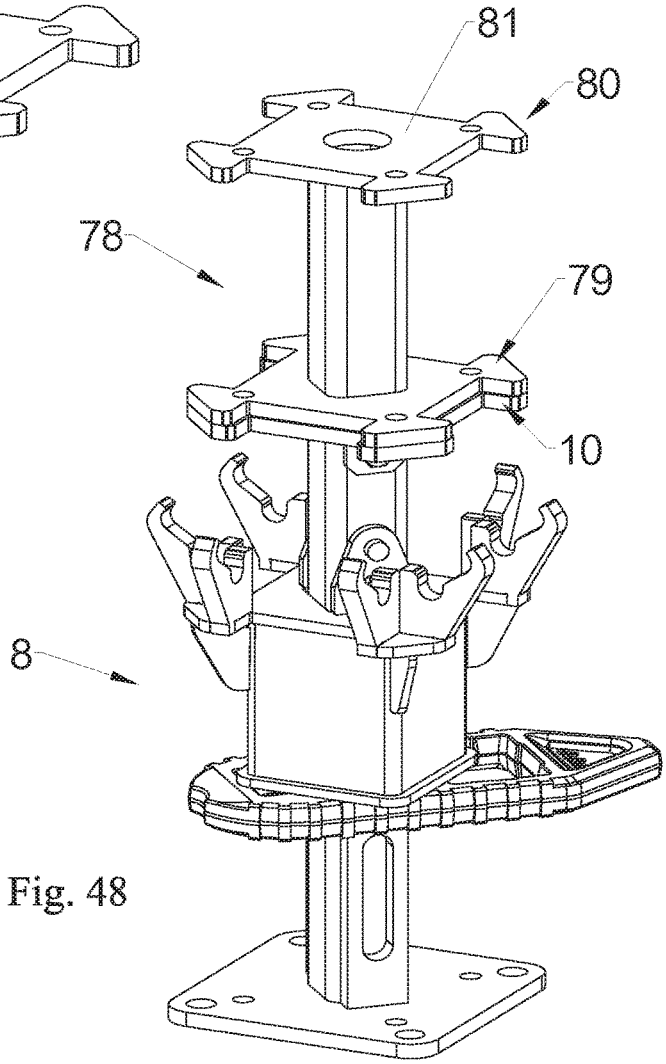

FIG. 48 shows the head member 8 used in the second pair 49 of support props 3. The head members 8 of the second pair 49 of support props 3 is identical to the head members 8 of the first pair 96 of support props 3 except for an extension device 78 fixed to the support plate 10 and extending upwards therefrom. The extension device 78 has a lower attachment plate 79 at its lower end and an upper support plate 80 at its upper end. The lower attachment plate 79 is attached to the support plate 10. The extension device 78 allows for lowering of the longitudinal support 50 without hindering the shoring of the poured concrete slab. Optionally, there is a releasable connection between the attachment plate 79 and the support plate 10. In that, the head member 8 and, if wished, the prop 3, can fast and easily be replaced by a conventional prop head and prop, which are, then, fastened to the extension device 78 in order to ensure continued shoring of the formwork sheet 2 positioned on top of the upper support plate 80 of the extension device 78 as well as the entire poured concrete slab until the concrete is entirely hardened and the shoring, i.e. the prop and head, may be removed. The upper support plate 80 has a top side 81 for supporting one of the formwork sheets 73. The support plate 10, the lower attachment plate 79 and the upper support plate 80 have recesses at corresponding positions to provide space for the respective beams. In the shown example, the lower attachment plate 79, the upper support plate 80 and the support plate 10 are identical.

The invention claimed is:

1. A formwork support system comprising:

a first pair of support props, a second pair of support props, a longitudinal beam with opposite ends attached to the first pair of support props, a longitudinal support with opposite ends attached to the second pair of support props, and a cantilever beam extending transversely to the longitudinal beam and the longitudinal support, respectively, the cantilever beam being supported on an upper side of the longitudinal support, the cantilever beam having a first end secured to the longitudinal beam wherein each support prop has a leg and a head member mounted on an upper end of the leg, the head member having a support plate with an upper side, the head member having a lowering device for lowering a middle part of the head member with respect to the support plate, the leg having a lower leg part, an upper leg part, and a connecting device for securing the upper leg part in a plurality of vertical positions with respect to the lower leg part.

2. The formwork support system according to claim 1, wherein the head members of the second pair of support props each have an extension device fixed to the support plate and extending upwards therefrom, the extension device having an upper support plate, a plurality of formwork sheets being supported on the support plates of the first pair of support props and the upper support plates of the second pair of support props.

3. A formwork support system comprising:

a first pair of support props, a second pair of support props, a longitudinal beam with opposite ends attached to the first pair of support props, a longitudinal support with opposite ends attached to the second pair of support props, and a cantilever beam extending transversely to the longitudinal beam and the longitudinal support, respectively, the cantilever beam being supported on an upper side of the longitudinal support, the cantilever beam having a first end secured to the longitudinal beam wherein a downwardly extending flange member is arranged at the first end of the cantilever beam, wherein the longitudinal beam has a lower slot extending in a longitudinal direction of the longitudinal beam, the flange member engaging the lower slot of the longitudinal beam.

4. The formwork support system according to claim 3, wherein a tongue member and the flange member are spaced from one another in a longitudinal direction of the cantilever beam.

5. The formwork support system according to claim 3, wherein a tongue member is pivotably arranged at the first end of the cantilever beam about a horizontal axis extending perpendicularly to a longitudinal direction of the cantilever beam.

6. A formwork support system comprising:

a first pair of support props, a second pair of support props, a longitudinal beam with opposite ends attached to the first pair of support props, a longitudinal support with opposite ends attached to the second pair of support props, a cantilever beam extending transversely to the longitudinal beam and the longitudinal support, respectively, the cantilever beam being supported on an upper side of the longitudinal support, the cantilever beam having a first end secured to the longitudinal beam, and wherein an upwardly extending tongue member is arranged at the first end of the cantilever beam, wherein the longitudinal beam has an upper slot extending in a longitudinal direction of the longitudinal beam, the tongue member engaging the upper slot of the longitudinal beam.

7. The formwork support system according to claim 1, wherein a sideward extending stop member is arranged at the first end of the cantilever beam.

8. The formwork support system according to claim 7, wherein the stop member is a lateral nose of a tongue member or the lateral extension of a flange member.

9. A formwork support system comprising:

a first pair of support props, a second pair of support props, a longitudinal beam with opposite ends attached to the first pair of support props, a longitudinal support with opposite ends attached to the second pair of support props, and a cantilever beam extending transversely to the longitudinal beam and the longitudinal support, respectively, the cantilever beam being supported on an upper side of the longitudinal support, the cantilever beam having a first end secured to the longitudinal beam wherein a fall protection device is mounted on the cantilever beam at a second end.

10. The formwork support system according to claim 9, wherein the fall protection device comprises a railing.

11. A method for installing a formwork support system, comprising the steps of:

arranging a first pair of support props on a floor of a building, arranging a second pair of support props on the floor of the building, attaching a first end and a second end of a longitudinal beam to the support props of the first pair of support props, respectively, attaching a first end and a second end of a longitudinal support to the support props of the second pair of support props, respectively, supporting a cantilever beam extending transversely to the longitudinal beam and the longitudinal support, respectively, on an upper side of the longitudinal support, and securing a first end of the cantilever beam to the longitudinal beam, wherein a protruding section of the cantilever beam horizontally extends beyond a floor edge of the floor.

12. The method according to claim 11, wherein the formwork support system is installed at a marginal area of the floor of the building.

13. The method according to claim 12, wherein the longitudinal support is arranged parallel to the floor edge at the marginal area of the building.

14. The method according to claim 11, wherein a tongue member at the first end of the cantilever beam is engaged with an upper slot of the longitudinal beam for securing the cantilever beam to the longitudinal beam.

15. The method according to claim 11, wherein the cantilever beam is initially supported on the longitudinal support in an interim position with a tongue member placed underneath and disengaged from an upper slot of the longitudinal beam, whereupon the cantilever beam is pivoted about its longitudinal direction so that the tongue member engages the upper slot.

16. The method according to claim 15, wherein a fork instrument is operated from the floor to pivot the cantilever beam in order to engage the tongue member with the upper slot of the longitudinal beam.

17. The method according to claim 11, wherein a fall protection element is mounted at a second end of the cantilever beam.

* * * * *